US008398206B2

(12) United States Patent
Yamamoto et al.

(10) Patent No.: US 8,398,206 B2
(45) Date of Patent: Mar. 19, 2013

(54) RECOVERY PROCESSING METHOD FOR PRINT HEAD, AND INKJET PRINTING APPARATUS USING THE SAME

(75) Inventors: Wakako Yamamoto, Sagamihara (JP); Hidehiko Kanda, Yokohama (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 12/958,264

(22) Filed: Dec. 1, 2010

(65) Prior Publication Data

US 2011/0134185 A1 Jun. 9, 2011

(30) Foreign Application Priority Data

Dec. 8, 2009 (JP) ..... 2009-278754

(51) Int. Cl.
*B41J 2/165* (2006.01)

(52) U.S. Cl. ..... 347/33; 347/35

(58) Field of Classification Search ..... 347/33
See application file for complete search history.

(56) References Cited

U.S. PATENT DOCUMENTS

| | | | | |
|---|---|---|---|---|
| 6,193,351 | B1 | 2/2001 | Yaegashi et al. | |
| 6,244,685 | B1 | 6/2001 | Yamada et al. | 347/33 |
| 6,382,765 | B1 | 5/2002 | Kanda et al. | |
| 6,447,095 | B1 | 9/2002 | Kanda et al. | |
| 6,746,096 | B2 | 6/2004 | Sakamoto et al. | |
| 6,854,826 | B2 | 2/2005 | Kanda et al. | |
| 7,118,190 | B2 | 10/2006 | Sakamoto et al. | |
| 7,735,946 | B2 | 6/2010 | Tanaka et al. | |
| 2008/0055357 | A1 | 3/2008 | Hamasaki et al. | |
| 2008/0143780 | A1 | 6/2008 | Sakamoto et al. | |
| 2008/0218554 | A1* | 9/2008 | Inoue | 347/33 |
| 2008/0291241 | A1* | 11/2008 | Kachi et al. | 347/33 |
| 2009/0135226 | A1 | 5/2009 | Sakamoto et al. | |
| 2009/0201354 | A1 | 8/2009 | Akiyama et al. | |
| 2009/0244161 | A1 | 10/2009 | Yamamoto et al. | |
| 2010/0118080 | A1 | 5/2010 | Tanaka et al. | |

FOREIGN PATENT DOCUMENTS

| | | |
|---|---|---|
| JP | 59-045161 | 3/1984 |
| JP | 7-148934 | 6/1995 |
| JP | 11-342620 | 12/1999 |

* cited by examiner

*Primary Examiner* — Matthew Luu
*Assistant Examiner* — Alexander D Shenderov
(74) *Attorney, Agent, or Firm* — Fitzpatrick, Cella, Harper & Scinto

(57) ABSTRACT

Wet wiping processing is performed on an ink ejection opening forming surface of a print head by use of a wiper. Then, as bubble removal processing, the print head is heated by use of either an electrothermal conversion element or a heat generating element located inside the print head, and then a control unit causes the print head to perform preliminary ejection K1 and preliminary ejection K2.

12 Claims, 22 Drawing Sheets

RECOVERY PROCESSING METHOD FOR PRINT HEAD, AND INKJET PRINTING APPARATUS USING THE SAME

BACKGROUND OF THE INVENTION

1. Field of the Invention

The present invention relates to a recovery processing method for a print head configured to perform a print operation by ejecting ink, and to an ink jet printing apparatus using the same.

2. Description of the Related Art

An inkjet printing apparatus configured to perform a print operation by ejecting ink onto a print surface of a print medium comprises a recovery processor, for example, as a measure for keeping normal ink ejection from ink ejection openings of a print head. The recovery processor performs the recovery processing for each of print heads of a print section.

It is known that such recovery processors configured to perform a sucking operation, a wiping operation, preliminary ejection (an operation to eject ink from ink ejection openings when a wiper used for the wiping operation passes over the ink ejection openings) (hereinafter referred to as preliminary ejection), a heating operation, and other operations. The recovery processor causes viscosity ink, minute air bubbles, and the like inside the print head to surely discharge to the outside, and also causes foreign objects, ink mist, and the like which adhere to an ink ejection opening forming surface on which the ink ejection openings of the print head are formed to remove.

As shown in Japanese Patent Laid-Open No. S59-045161 (1984) and H07-148934 (1995), for example, a technique widely used in the wiping operation is to clean the ink ejection opening forming surface by use of the wiper when a certain condition is met. The case where the certain condition is met may be after ejection of the ink from the print head, after a lapse of a predetermined period without use of the print head, or after execution of the sucking operation, for example.

This enables performance of an inkjet head which serves as liquid ejecting means mounted in an inkjet printing apparatus as a liquid ejecting apparatus to maintain. In this case, it has also been proposed to apply the above-described technique of preliminary ejection in order to improve the cleaning performance with the wiper and to remove the viscosity ink and paper fluff (dust) adhering to the ink ejection opening forming surface.

For example, Japanese Patent Laid-Open No. S59-045161 (1984) discloses a method of preventing drying at ink ejection openings of a print head, interfusion of bubbles, and clogging ejection opening (which are referred to as nozzles in Japanese Patent Laid-Open No. S59-045161 (1984)) of the ink ejection openings. According to this method, in a wiping operation in an arrangement direction of multiple ink ejection openings of a print head by a cleaner, the cleaner performs cleaning by scrubbing a tip end surface of the ink ejection opening of the print head where the ink ejection openings are formed, while the ink is ejected from the ink ejection openings to be used for image formation or the other ink ejection opening not to be used for image formation (recording or printing for character formation or the like). In this way, the tip end surface is cleaned while sweeping the ink thereon. As a result, there is an effect of removing the ink having relatively high viscosity which adheres to the tip end surface where the ink ejection openings are formed.

Meanwhile, Japanese Patent Laid-Open No. H07-148934 (1995) discloses a maintenance method for an inkjet print head for preventing occurrence of clogging at ink ejection openings of a print head after disuse for a long time. According to this method, a print head is moved to a wiper and is cause to eject ink from ink ejection openings onto the wiper. Then, accumulated ink is wiped off a nozzle plate with the wet wiper.

Moreover, in Japanese Patent Laid-Open No. H 11-342620 (1999), there has been proposal for a method of moistening an ink ejection opening forming surface of a print head before and during a wiping operation using a wiper when the wiper wipes the ink ejection opening forming surface of the print head in a direction perpendicular to the arrangement direction of ink ejection openings. This method makes it easier to remove the ink adhering to the ink ejection opening forming surface because ink from the print head adheres not only to a leading surface of a wiper blade but also to a leading edge region and a tailing edge region of the print head. Thus, wiping in combination with ink ejection leads to improvement in stain removal performance.

SUMMARY OF THE INVENTION

In the above-described recovery processing, when the preliminary ejection is executed during the wiping operation, the ink ejection opening forming surface is cleaned upon being wiped with the wiper blade.

However, since a tip end of the wiper blade traces the ink ejection opening forming surface, some air in the atmosphere is pushed into the ink ejection openings. Hence, there is a risk of generating air bubbles inside the ink ejection openings, which may result in deterioration of image quality of a printed image thus obtained. In particular, the wiping operation may be often carried out after "air bubbles inside the nozzles are removed" through the recovery of the sucking operation and the heating operation as described above, with the result that the wiper blade generates air bubbles again after the existing air bubbles are removed.

In view of the above described problem, the prevent invention aims to provide a recovery processing method for a print head. The recovery processing method for a print head can enhance an effect to remove an adhered substance such as viscosity ink fixed to an ink ejection opening forming surface of a print head after recovery processing without leaving air bubbles inside ink ejection openings of the print head.

In order to achieve the above-described object, a recovery processing method for a print head comprises the steps of: a wet wiping processing for removing an adhered substance by touching slidably a wiper member to the ink ejection opening forming surface of the print head having an ink ejection opening forming surface where a plurality of ink ejection openings are formed while an ink is ejected from the ink ejection openings toward the wiper member, the wiper member provided to be movable relatively to the print head; and a bubble removal processing for removing a bubble generated near the ink ejection opening forming surface of the print head from which the adhered substance is already removed by slidably touching the wiper member in the wet wiping processing.

In addition, an ink jet printing apparatus according to the present invention comprises: a recovery processing section having a wiper member provided to be movable relatively to a print head having an ink ejection opening forming surface where a plurality of ink ejection openings are formed, the wiper member for removing an adhered substance on the ink ejection opening forming surface by coming into contact with the ink ejection opening forming surface; a movement mechanism for moving any one of the wiper member and the print head; a bubble removing unit configured to remove a bubble generated near the ink ejection opening forming surface of the print head; and a control unit configured to perform operation control of the recovery processing section, the print head, and the bubble removing unit, wherein the control unit causes the movement mechanism to perform an operation to remove the adhered substance by slidably touching the wiper member to the ink ejection opening forming surface of the print head, while causing the print head to eject an ink from the ink ejection openings toward the wiper member, and thereafter the control unit causes the bubble removing unit to perform an operation to remove the bubble.

Furthermore, an inkjet printing apparatus according to another aspect of the present invention comprises: a recovery processing section having a wiper member provided to be movable relatively to a print head having an ink ejection opening forming surface where a plurality of ink ejection openings are formed, the wiper member for removing an adhered substance by coming into contact with the ink ejection opening forming surface; a movement mechanism for moving any one of the wiper member and the print head; a bubble removing unit configured to remove a bubble generated near the ink ejection opening forming surface of the print head; and a control unit configured to perform operation control of the recovery processing section, the print head, and the bubble removing unit, wherein the control unit causes the movement mechanism to perform a wet wiping operation to remove the adhered substance by slidably touching a tip end of the wiper member to the ink ejection opening forming surface of the print head, while causing the print head to eject an ink for a predetermined period from the ink ejection openings toward the wiper member, then the control unit causes the movement mechanism to perform a dry wiping operation to remove the adhered substance by slidably touching the wiper member to the ink ejection opening forming surface of the print head without causing the print head to activate, and thereafter the control unit causes the bubble removing unit to perform an operation to remove the bubble after causing the print head to perform a preliminary ejection operation.

According to the recovery processing method for a print head of the present invention and the inkjet printing apparatus using the same, the wet wiping processing step comprises the bubble removal processing step of removing the bubbles generated in the vicinity of the ink ejection opening forming surface of the print head after the adhered substance is removed by scraping with the tip end of the wiper member. Therefore, it is possible to enhance an effect to remove the adhered substance such as viscosity ink adhering to the ink ejection opening forming surface after recovery processing without leaving bubbles inside the ink ejection opening of the print head.

Further features of the present invention will become apparent from the following description of exemplary embodiments (with reference to the attached drawings).

DESCRIPTION OF THE EMBODIMENTS

Figure 2:
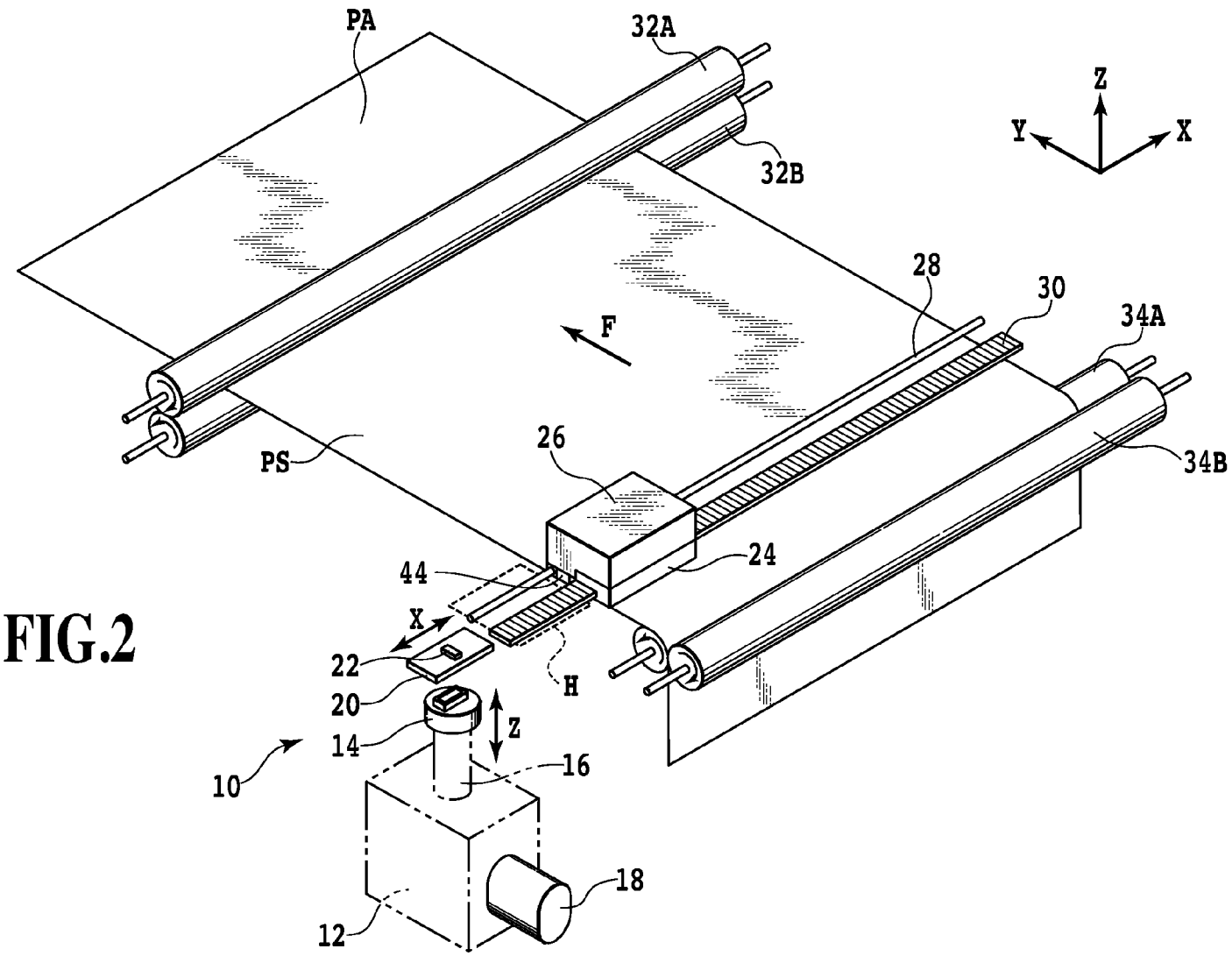
FIG. 2 is a perspective view schematically showing a configuration of principal part of the inkjet printing apparatus to which an example of the recovery processing method for a print head according to the present invention is applied.

FIG. 2 schematically shows a principal part of a serial-type inkjet printer serving as an inkjet printing apparatus to which some embodiments of a recovery processing method for a print head according to the present invention are applied. It is to be noted that an example of the recovery processing method for a print head according to the present invention is also applicable to other inkjet apparatuses such as printers (including multifunction printers) or industrial printing apparatuses including manufacturing apparatuses for electronic devices and textile printing apparatuses.

In FIG. 2, a chassis (not shown) of an apparatus body forms a framework of an inkjet printer and holds each print operation mechanism to be described later. Each print operation mechanism to be embedded and held inside the apparatus body comprises a carrier section, and an automatic feeder section (not shown) configured to feed print sheets PA one by one sequentially into the apparatus body along a direction indicated with an arrow F, each of the print sheets PA serving as a print medium.

The carrier section guides the print sheets PA sent one by one out of the automatic feeder section to a predetermined printing position on a platen (not shown) and also guides the print sheets from the printing position to a discharge section. In addition, the print operation mechanism also comprises a printing section configured to perform desired printing on a printing surface of the print sheet PA conveyed to the printing position, and also comprises a recovery section 10 configured to perform recovery processing of a print head 44 of the printing section to be described later.

The above-described carrier section comprises carrier rollers 32A and 32B, sheet feeding rollers 34A and 34B, and a sheet discharging roller (not shown). The sheet discharging roller conveys, toward the discharge section, the printed print sheet PA conveyed by the sheet feeding rollers 34A and 34B.

The carrier rollers 32A and 32B, and the sheet feeding rollers 34A and 34B convey the print sheets PA intermittently in a predetermined feed corresponding to a print operation by the print head 44 of the printing section and to a reciprocating operation of a carriage 24, the print sheets PA sent one by one out of the automatic feeder section.

The carrier rollers 32A and 32B, the sheet feeding rollers 34A and 34B, and the sheet discharging roller are respectively driven by a rotational force of a driving motor 78 (see FIG. 7) transmitted thereto through a reduction gear mechanism or the like. The drive of the driving motor 78 is controlled by a control block to be described later. Here, in the above-described example, the print sheet PA as the print medium may be made of paper, a plastic sheet, or the like. In the case of a manufacturing apparatus or a textile printing apparatus provided with the inkjet printer, the print sheet PA may be made of a glass substrate or a textile.

According to the configuration described above, an image is printed on the printing surface of print sheet PA by use of the print head 44 to be described later, while main scanning and sub-scanning are repeated. The main scanning causes the print head 44 to perform an ink ejecting operation while moving the print head 44 in a main scanning direction (in an X coordinate axis direction in an orthogonal coordinate system in FIG. 2). The sub-scanning causes the print sheet PA in a sub-scanning direction to conveys, the sub-scanning direction (in a Y coordinate axis direction in the orthogonal coordinate system in FIG. 2) which is orthogonal to the main scanning direction.

Printing Section

As main constituents, the printing section comprises the carriage 24 movably supported by a guide shaft 28, and a head ink cartridge 26 (see FIG. 3) detachably mounted on this carriage 24 and provided with an ink tank section 40 and the print head 44.

A timing belt 30 is connected to a bottom surface portion of the carriage 24. The timing belt 30 is wound around a pair of pulleys rotatably provided on the above-described chassis away from each other with a predetermined interval interposed therebetween. One of the pulleys is connected to an output shaft of a carriage motor 80 (see FIG. 7). As the carriage motor 80 subject to drive control by the control block to be described later is set to an active state, the carriage 24 is caused to reciprocate along the X coordinate axis in FIG. 2 in a position above the printing surface of the print sheet PA which is conveyed onto a platen although not shown in the figure.

Moreover, when the print head 44 performs no print operation or when the print head 44 performs the recovery processing, the carriage 24 stands by in a home position H remote sideways from a conveyance path for the print sheet PA as indicated with a dashed line in FIG. 2. Before the print head 44 starts the print operation, the carriage 24 standing by at the home position H together with the print head 44 initiates a movement in the direction of the X coordinate axis direction when a print operation start instruction and image data, which are transmitted from a host computer to be described later, are inputted to an image input section. In this case, the print head 44 performs a printing by ejecting ink from multiple ink ejection openings toward a print surface PS. When the print operation of the print head 44 based on the image data corresponding to one scanning operation is finished, the carriage 24 returns to the home position H and moves again in the X coordinate axis direction. Hence the print head 44 performs the print operation based on the image data corresponding to a subsequent scanning operation.

An end of a flexible print cable FPC (not shown) is connected to the carriage 24. Meanwhile, the end of the flexible print cable FPC is connected to a carriage board mounted on the carriage 24. The carriage board is a printed board unit mounted on the carriage 24 and functions as an interface for communicating signals with the print head 44 through the flexible print cable FPC. The carriage board detects a relative position between an encoder scale and an encoder sensor and outputs a detection output signal to the control block to be described later, through the flexible print cable FPC. The relative position between the encoder scale and the encoder sensor is detected based on a pulse signal to be outputted from the encoder sensor with the movement of the carriage 24 along the encoder scale (not shown). Both ends of the encoder scale are supported by two side portions of the chassis, respectively.

A contact portion on the other end of the flexible print cable FPC is electrically connected to a contact portion of an electric wiring board 92 provided on the head ink cartridge 26. In this way, it is possible to exchange a variety of information for printing, to supply the print head 44 in the ink cartridge 26, and so forth with power.

Head Ink Cartridge

Figure 3:
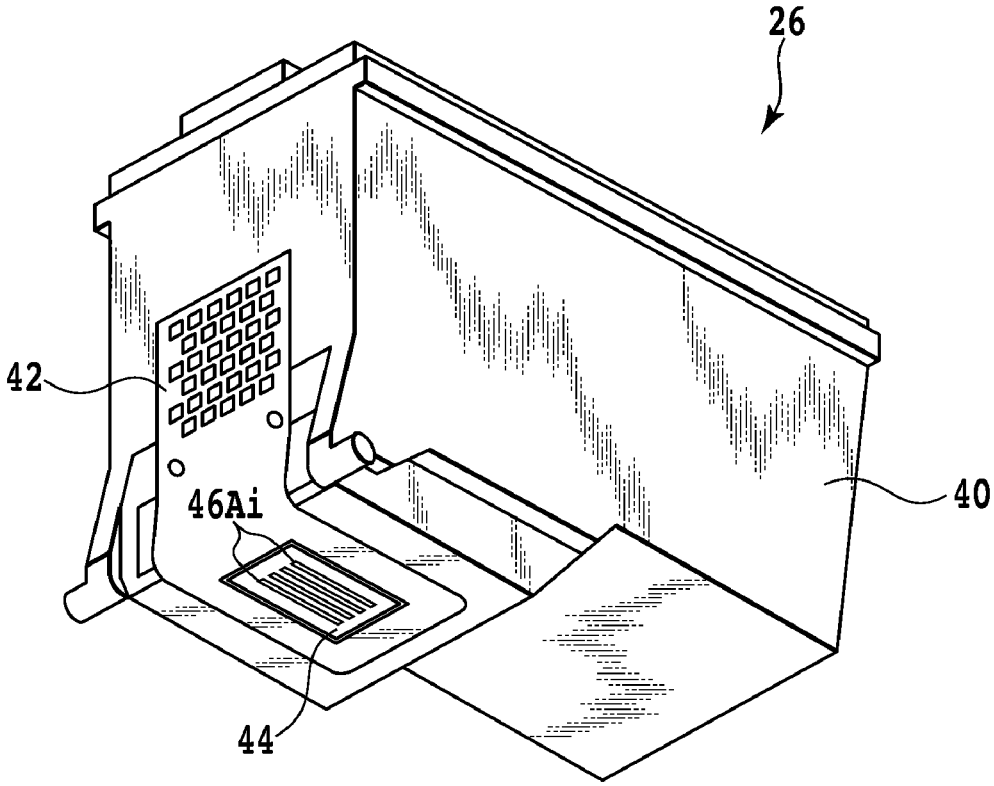
FIG. 3 is an enlarged perspective view showing a head ink cartridge embedded in a printing section in the example shown in FIG. 2.

As enlarged in FIG. 3, the head ink cartridge 26 used for the printing section has sub-ink tank sections 40 configured to individually pool dye inks in respective colors, and the print heads 49. The print heads 44 eject the respective inks supplied from the sub-ink tank sections 40 out of the ink ejection openings in accordance with printing information from the host computer to be described later.

The respective sub-ink tank sections 40 has multiple ink accommodating chambers each having a given inner volume. The respective ink accommodating chambers contain the dye inks in the respective colors including black, cyan, magenta, and yellow, for example. Here, the inks are not limited only to the dye inks but may also be pigment inks, for example.

The print heads 44 comprises a printing element board for each of the inks. Moreover, the print head 44 comprises a first plate, an electric wiring board, a second plate, a flow path forming member, a filter, sealing rubber, and the like which are not shown herein. The print head 44 is provided so as to be opposed to the print surface PS of the print sheet PA and to correspond to each of the ink accommodating chambers.

The printing element board is made of a single board and is formed as a side shooter type applying the Bubble Jet (registered trademark) mode which is configured to perform printing by using an electrothermal converting device (an electrothermal conversion element) that generates thermal energy for causing film boiling of the ink in response to an electric signal, for example.

The printing element board comprises a board made of silicon (Si) and provided with a thin film on a surface thereof, and an orifice plate to be formed on the board, for example.

Figure 5A:
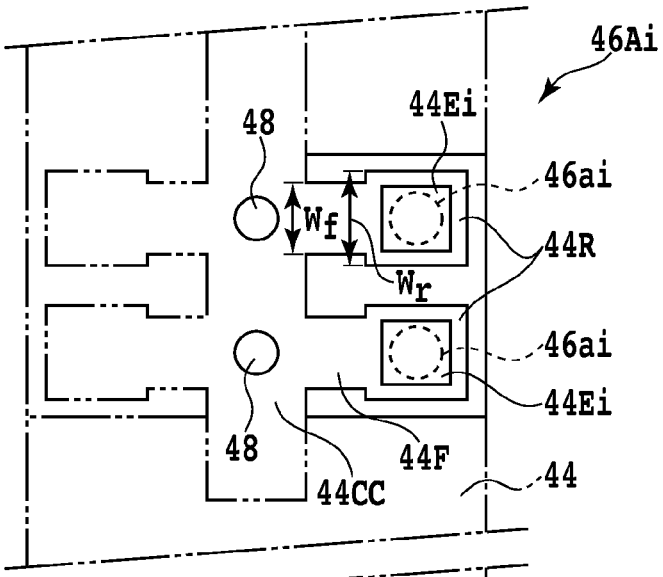
FIGS. 5A, 5B, and 5C are partial enlarged cross-sectional views each showing a part of the print head in the head ink cartridge illustrated in FIG. 4.

The above-described board made of silicon (Si) is formed so as to define ink supply ports serving as flow paths for the inks in the respective colors. Here, the ink supply ports are formed of long-groove through holes which are integrally opened almost at the center on a rear surface. As partially enlarged in FIG. 5A, A plurality of electrothermal conversion elements 44Ei (i=1 to 8) are arranged and formed on each line so as to face one another along a peripheral edge in a longitudinal direction of the ink supply ports. Note that an ink ejection opening array 46Ai configured to eject the black ink is typically illustrated in FIG. 5A, for example.

Figure 4:
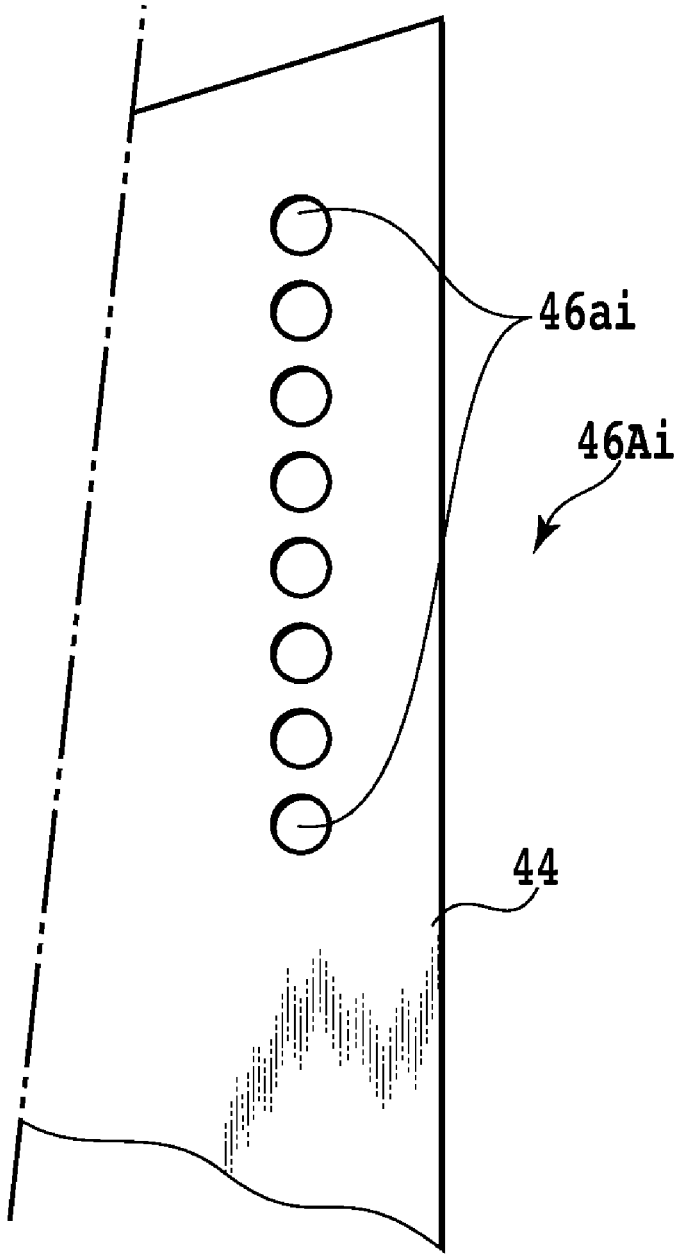
FIG. 4 is a partial enlarged plan view showing part of a print head in the head ink cartridge to which a first embodiment of the recovery processing method for a print head according to the present invention is applied.

As partial enlarged in FIG. 4, expansion chambers 44R, ink flow path walls, and ink ejection openings 46*ai* (i=1 to 8) are formed in accordance with a photolithographic technique on the orifice plate to be formed on the board. The expansion chambers 44R correspond to the respective electrothermal conversion elements 44Ei. The ink flow path walls form respective ink flow paths 44F for communicating the respective expansion chambers 44R with a common liquid chamber 44CC. Note that the ink ejection opening array 46Ai configured to eject the black ink is typically illustrated in FIG. 4, for example.

Accordingly, the adjacent ink ejection openings 46*ai* and the adjacent expansion chambers 44R are partitioned by the ink flow path walls.

Multiple filters 98 are provided in the common liquid chamber 44CC for the purpose of trapping dusts or the like if the dusts are included in the ink supplied from the ink supply ports, the common liquid chamber 94CC communicating with the ink supply ports.

Two ink ejection opening arrays 46Ai formed of the ink ejection openings 46*ai* are formed in a moving direction of the printing element board, i.e., in a direction substantially orthogonal to the direction along the x coordinate axis in FIG. 2 so as to correspond to the arrays of the electrothermal conversion elements 44Ei.

Each ink ejection opening 46*ai* is made of a circular hole having a cross-sectional area capable of ejecting an ink droplet equal to 5 pl, for example, or in a diameter of 16.4 μm to be more precise. Dimensions of the expansion chambers 44R, the ink flow paths 44F, and the electrothermal conversion elements 44Ei communicated with the respective ink ejection openings 46*ai* are adjusted accordingly. To be more precise, a width Wr of each side of the expansion chamber 44R is set equal to 29 (μm) while a width Wf of the ink flow path 44F is set equal to 22.5 (μm). The electrothermal conversion element 44Ei is formed in a rectangle having dimensions of 19.4×21.6 (μm).

The above-described head ink cartridge 26 is circulated in the market in a wrapped state by attaching a protective tape (not shown) onto a surface thereof so as to occlude the ink ejection openings of the print head.

Figure 6:
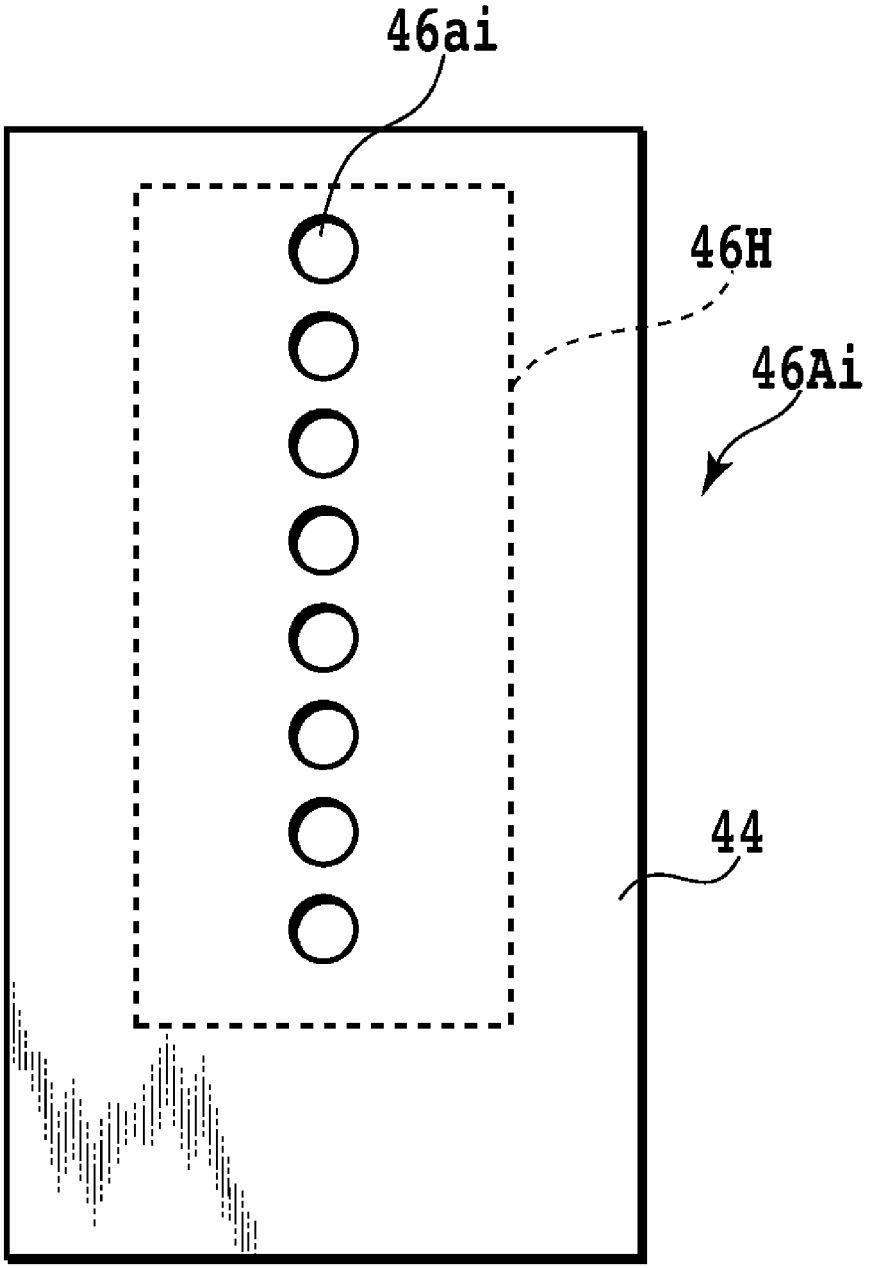
FIG. 6 is a partial enlarged plan view showing a part of the print head illustrated in FIG. 4 together with a heat generating element.

Meanwhile, as shown in FIG. 6, the print head 44 comprises a heating board provided with a heat generating element 46H configured to heat the print head 44. Further, the heating board serving as heating unit comprises a diode sensor 82 (see FIG. 7) which is configured to detect a temperature of the print head 44 and to transmit a detection output signal.

The example of using the print head comprising the printing element made of the heat generating element has been described above. However, without limitation to the foregoing example, it is also possible to employ other modes such as a mode using a piezo element as a piezoelectric element, a mode using en electrostatic element or a mode using a MEMS element. In the example using the piezoelectric element (piezo element) as the printing element, the print head may be separately provided with a heat generating element for raising the temperature of the ink.

Recovery Processing Section

The recovery processing section 10 comprises a cleaning wiper unit, a wiper unit moving mechanism, a cap 14, and the above-described heating board, for example. The cleaning wiper unit is located in the above-described home position H so as to be reciprocable within a range of a predetermined distance along the X coordinate axis. Although illustration is omitted, the wiper unit moving mechanism movably supports the cleaning wiper unit. The cap 14 is supported in a position below the cleaning wiper unit so as to move up and down and is configured to cover an entire ink ejection opening forming surface of the print head 44 located immediately thereabove.

The cleaning wiper unit comprises a wiper 22 serving as a wiper member, and a wiper holder 20 configured to hold the wiper 22.

When the cap is moved to the position below the wiper holder 20 and stands by in the position, the wiper holder 20 is caused to slide along the X coordinate axis shown in FIG. 2 by an unillustrated reciprocation mechanism. In this way, the wiper holder 20 is configured to wipe the dust such as ink droplets or paper powder remaining on the ink ejection opening forming surface while allowing a tip end of the wiper 22 to touch slidably to the ink ejection opening forming surface of the print head 44.

The cap 14 comprises a structure capable of moving between a sealed position and an open position which is to be located away from the ejection opening forming surface when the position is caused to move downward by a hoisting and lowering mechanism 16.

In the sealed position, the cap 14 is lifted up along a Z coordinate axis direction in FIG. 2 by use of the hoisting and lowering mechanism 16, of which illustration of the detailed configuration is omitted herein. Hence, the cap 14 is in close contact with the ink ejection opening forming surface of the print head 44 located in a position immediately above the home position H.

The reciprocation mechanism and the hoisting and lowering mechanism 16 described above are driven by a driving force from an output shaft of a recovery system motor 18 (see FIG. 7) to be described later, via a reduction mechanism 12. The recovery system motor 18 is controlled by a recovery system control circuit 68 (see FIG. 7) to be described later.

Meanwhile, the above-described heating board is controlled by a head temperature control circuit 70 to be described later.

Control Block

Figure 7:
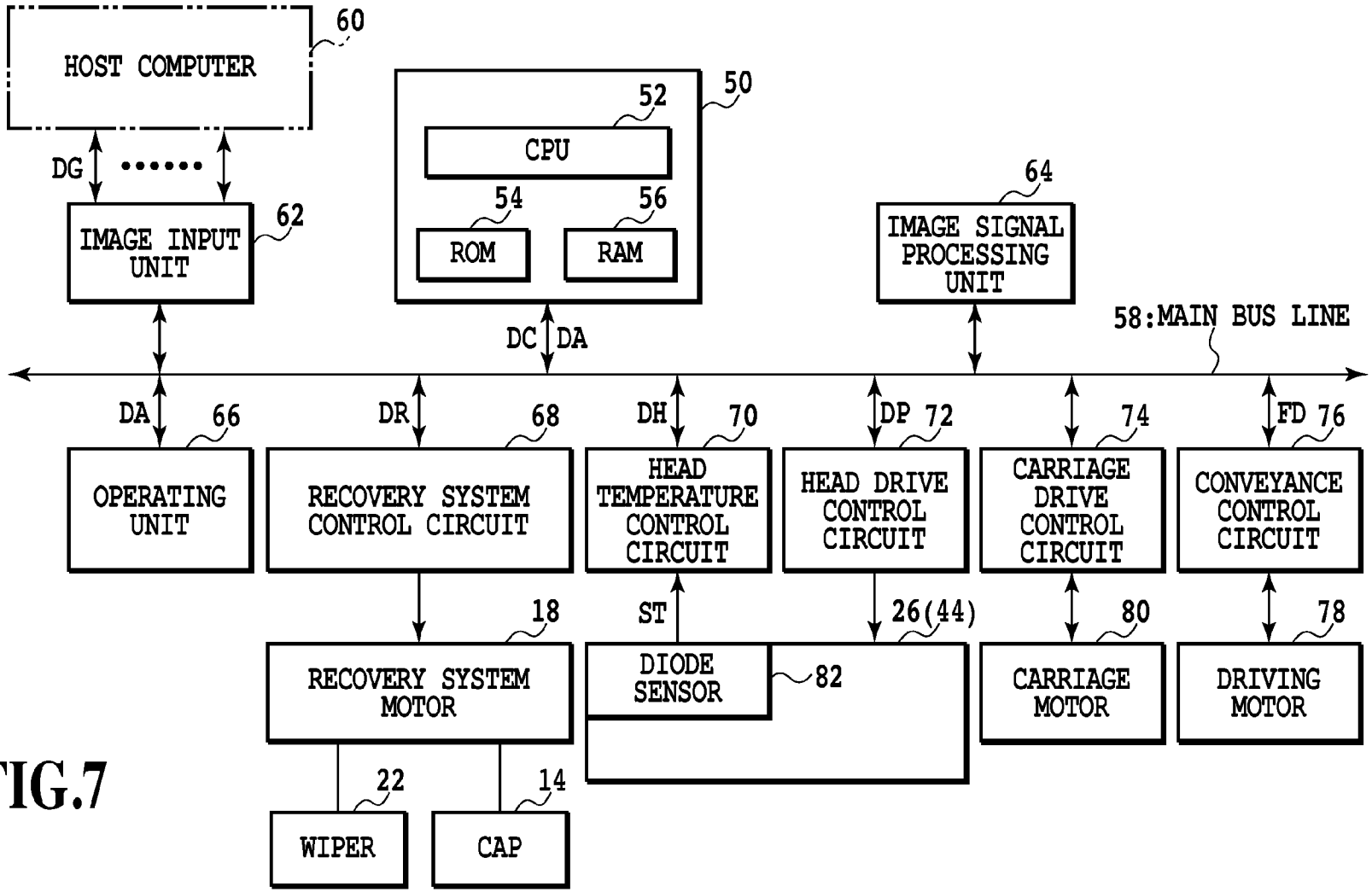
FIG. 7 is a block diagram showing a configuration of a control block embedded in the ink jet printing apparatus illustrated in FIG. 2.

In addition to the configuration described above, an inkjet printer is provided with a control block as shown in FIG. 7. The control block performs control of the print operation by the print head 44, control to convey the print sheet PA, control of movement of the carriage 24, and control of the wiping operation by the wiper 22 and the operation of the cap 14 in the recovery section 10. The control block comprises a control unit 50 serving as a controller. The control unit 50 comprises a central processing unit (CPU) 52, a read-only memory (ROM) 54, and a random access memory (RAM) 56 as principal constituents. The central processing unit (CPU) 52 performs operation control of the print head 44, the carriage motor 80, the recovery system motor 18, the driving motor 78, and the like by way of respective control circuits. The read-only memory (ROM) 54 and the random access memory (RAM) 56 respectively store program data, and various supplied control data, image data or the like.

Meanwhile, an image input section 62 and an image signal processing section 64 are also connected to the control unit 50 through a main bus line 58. Further, an operating section 66, the recovery system control circuit 68, the head temperature control circuit 70, a head drive control circuit 72, a carriage drive control circuit 74, a conveyance control circuit 76 for the print sheet PA, and the like to be described later are connected to one another through the main bus line 58.

The central processing unit (CPU) 52 performs the operation control based on a data group DG which is supplied from a host computer 60 to be provided separately from the inkjet printer, for example, through an interactive communication section (not shown in the figure). Specifically, the control unit 50 controls the respective devices including the image input section 62, the image signal processing section 64, the head drive control circuit 72, and the recovery system control circuit 68 via the main bus line 58 in accordance with programs stored in the read-only memory (ROM) 54.

The data group DG including the control data from the host computer 60 and the image data representing an image to be printed, a detection data group DS including data to be supplied from the encoder sensor (not shown in the figure), a sheet end detection sensor, and the like are supplied to the central processing section 52. Moreover, other data including an operation start instruction from the operating section 66, which represents power-up of the inkjet printer, as well as data DA representing instructions for preliminary ejection and recovery processing are also supplied to the central processing section 52 through the main bus line 58.

The read-only memory (ROM) 54 stores the programs for controlling the respective devices including the image input section 62, the image signal processing section 64, the head drive control circuit 72, and the like.

Meanwhile, the random access memory (RAM) 56 has a recording region as a data buffer for printing data corresponding to the data group DG and the detection data group DS. Moreover, the random access memory (RAM) 56 has a storage region as a data buffer for controlling the respective motors.

The central processing section 52 causes the image signal processing section 64 to execute predetermined image processing based on the data group read out of the RAM 56. In this way, the image signal processing section 64 forms print operation control data and supplies the print operation control data to the head drive control circuit 72 through the main bus line 58, the head drive control circuit 72 configured to control the print head 44. Here, the respective data stored in the RAM 56 are read out one bandwidth by one bandwidth in response to readout timing signals supplied from the central processing section 52 and are sequentially supplied to the image signal processing section 64 together with various synchronization signals and clock signals for the purpose of the image processing.

The image processing to be executed in the image signal processing section 64 includes masking data processing, palette conversion for making reference to a color conversion data table based on the respective data and obtaining color data, multi-value/binary value conversion processing for subjecting the obtained color data to binarization processing. In addition, the image processing includes signal distribution processing for distributing binarized signals and registration adjustment, and the like.

The head drive control circuit 72 forms a printing drive control signal in response to the synchronization signal based on the print operation control data from the image signal processing section 64 and supplies the printing drive control signal to the print head 44. The print head 44 performs the print operation by ejecting ink droplets ID onto the printing surface PS of the print sheet PA which is intermittently conveyed based on the printing drive control signal.

Meanwhile, the central processing section 52 causes the print head 44 to perform the print operation as described above and supplies control data CD to the carriage drive control circuit 74 based on the detection data group DS. In this way, the carriage 24 mounting the head ink cartridge 26 reciprocates above the print surface PS of the print sheet PA along the x coordinate axis direction in FIG. 2. The carriage drive control circuit 74 forms a drive control signal based on the control data CD and supplies the drive control signal to the carriage motor 80. In this way, when the carriage motor 80 is activated, the carriage 24 is allowed to move every time the printing surface PS of the print sheet PA is conveyed at a predetermined amount as will be described later.

The central processing section 52 supplies control data FD to the conveyance control circuit 76 in order to convey the printing surface PS of the print sheet PA in a predetermined sheet feeding amount, e.g., a feeding amount equivalent to 1200 dpi in a direction orthogonal to the direction of conveyance by the carriage 24, i.e., in the direction indicated with the arrow F in FIG. 2. The conveyance control circuit 76 forms a drive control signal based on the control data FD and supplies the drive control signal to the driving motor 78. In this way, when the driving motor 78 is activated, the print sheet PA is sent at the predetermined feeding amount every time the print operation of the print head 44 is completed.

The central processing section 52 causes the recovery system control circuit 68 to perform the above-described operation of the recovery section based on the operation start instruction from the operating section 66 in the inkjet printer, which represents power-up of the inkjet printer, as well as on the instruction data DA representing the instructions for the preliminary ejection and the recovery processing. Here, the instruction data DA from the operating section 66 also includes data representing an instruction for replacement of the head ink cartridge 26.

In this case, the central processing section 52 forms control data DH so as to adjust and control the temperature of the print head 44 in order to remove air bubbles in the recovery processing as will be described later. The central processing section 52 supplies the control data DH to the head temperature control circuit 70 and controls operation of the heating board provided with the heat generating element 46H. The head temperature control circuit 70 forms control pulse signals for the heat generating element 46H based on a detection output signal ST from the diode sensor 82 and on the control data DH, in order to perform feedback control such that the print head 44 is kept at a predetermined temperature. The head temperature control circuit 70 supplies the control pulse signals to the heating board.

Meanwhile, the central processing section 52 causes the head drive control circuit 72 to maintain the temperature of the print head 44 at the predetermined temperature, or to preliminarily heat the print head 44 before starting the print operation, for example, based on a detection output signal ST from the diode sensor 82. Namely, the head drive control circuit 72 forms printing drive control signals which are low enough not to cause ink ejection and supplies the printing drive control signals to the print head 44.

Note that the host computer 60 is connected to the image input section 62 in the above-described example. However, the present invention is not limited to only this example and it is also possible to employ a configuration to connect a digital camera to the image input section 62, for instance.

(First Embodiment)

Figure 1:
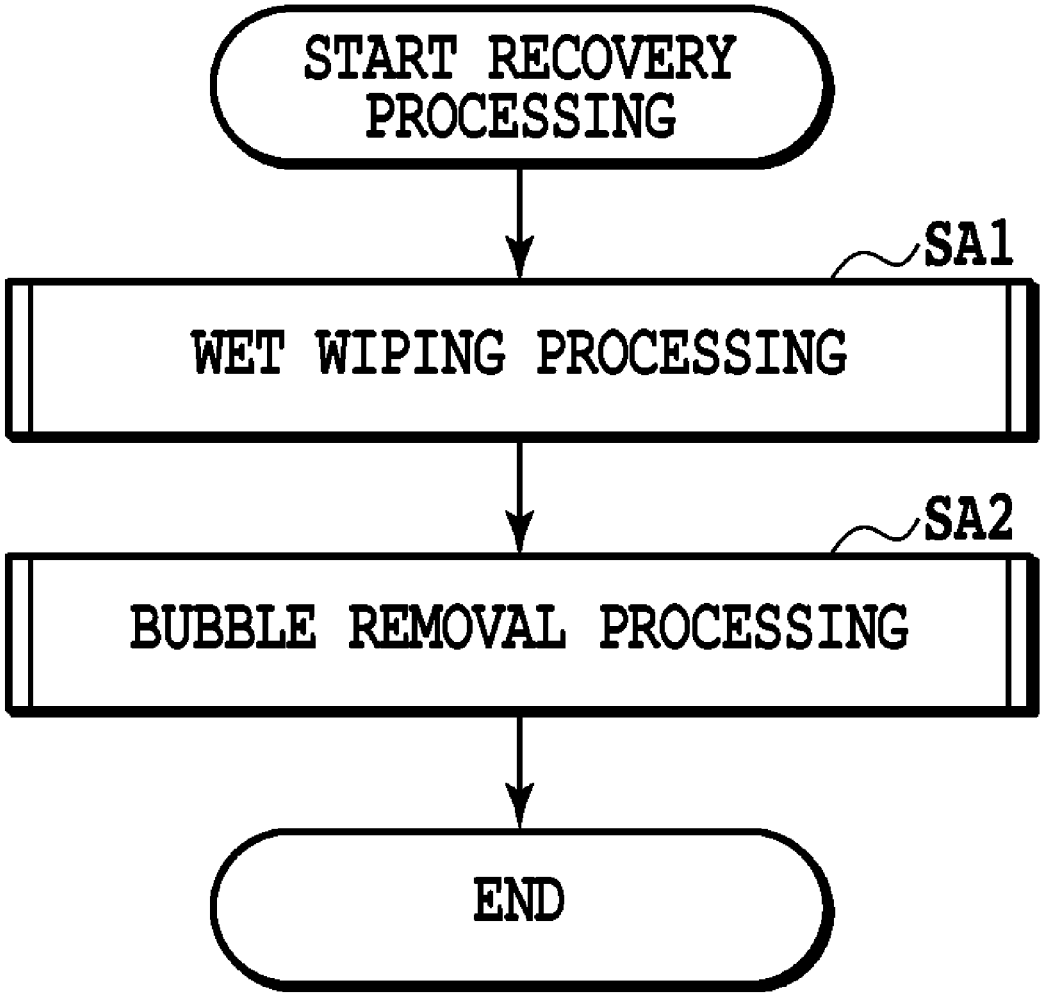
FIG. 1 is a flowchart showing an example of a program to be executed by a control unit comprising a microcomputer, for example, and embedded in an inkjet printing apparatus to which each embodiments of a recovery processing method for a print head according to the present invention are applied.

As shown in FIG. 1, a first embodiment of the recovery processing method for a print head includes a wet wiping processing step and an air bubble removal processing step.

As enlarged in FIG. 5B, for example, a typical example of performing the recovery processing may take place occurrence of ejection failure of the ink attributable to adhesion of an adhered substance FS formed of a viscosity ink (hereinafter also referred to as a viscosity ink substance FS) inside the print head 44 to a peripheral edge (in the vicinity of the ink ejection opening forming surface) or inside of the ink ejection openings 46*ai*. A conceivable case of the ink getting thickened inside the print head 44 may be caused by the ink in the vicinity of the ink ejection openings 46*ai* being thickened as a result of erroneous power-down of the inkjet printer before the cap 14 is attached to the print head 44, for example.

When this situation is confirmed by a user, the data DA representing the instruction for the recovery processing are supplied to the control unit 50 by an operation of the operating section 66 by the user.

In FIG. 1, the control unit 50 starts the recovery processing based on the data DA representing the instruction from the operating section 66 for the recovery processing, then executes a wet wiping processing program in step SA1 and then goes to step SA2. Next, in step SA2, the control unit 50 executes an air bubble removal processing program and then terminates the recovery processing.

At the starting point of the wet wiping processing program described above, the ink ejection opening forming surface of the print head 44 located in the home position H is supposed to be covered with the cap 14.

Figure 9:
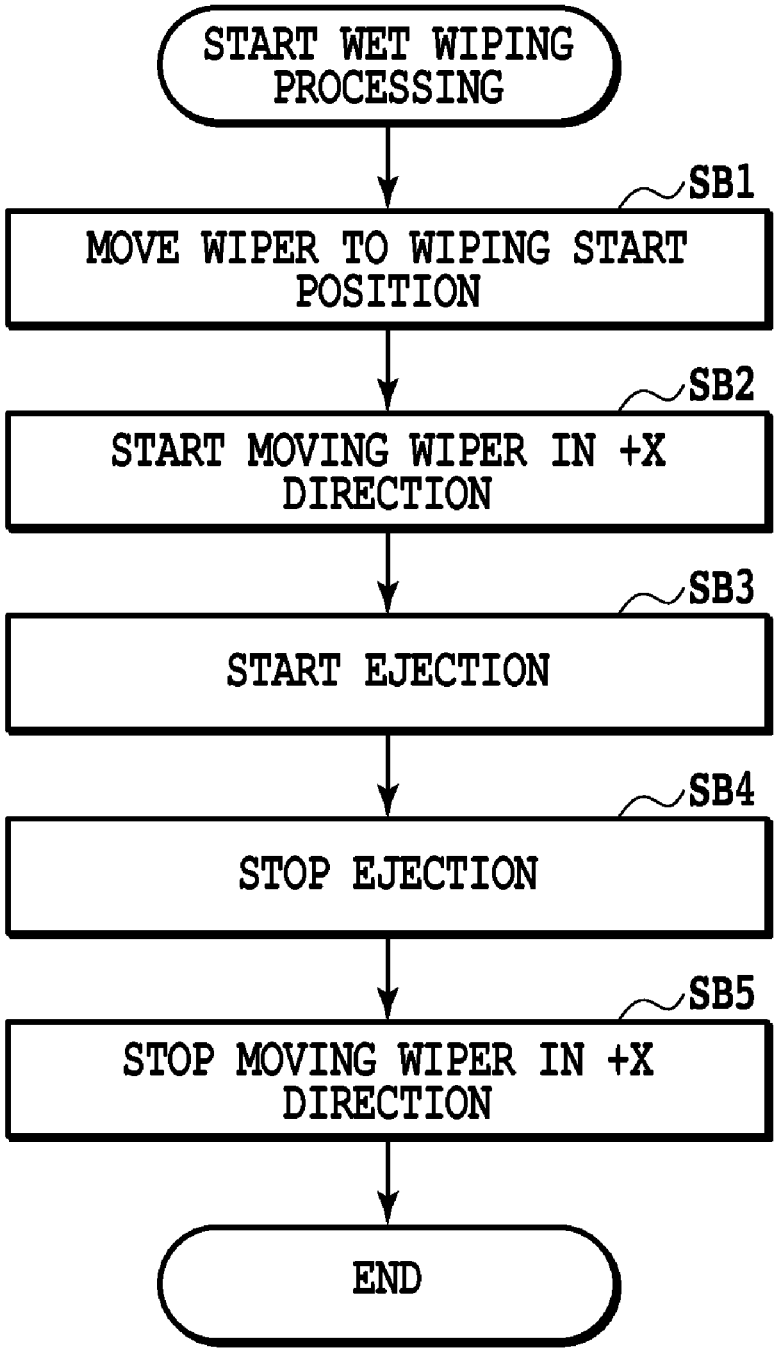
FIG. 9 is a flowchart showing an example of a program to be executed by a control unit in a wet wiping operation in the example shown in FIG. 2 when the control unit is formed of a microcomputer, for example.

As shown in FIG. 9, the control unit 50 forms control data DR so as to separate the cap 14 from the ink ejection opening forming surface and to move the wiper 22 for a predetermined distance from the ink ejection opening forming surface based on the data DA representing the instruction for the recovery processing from the operating section 66. The control unit 50 supplies the control data DR to the recovery system control circuit 68. In this way, the recovery system control circuit 68 forms a control signal in order to move the cap 14 down along the Z coordinate axis direction in FIG. 2 and to move the wiper 22 for the predetermined distance at a predetermined moving velocity along the X coordinate axis, and then supplies the control signal to the recovery system motor 18.

Figure 8A:
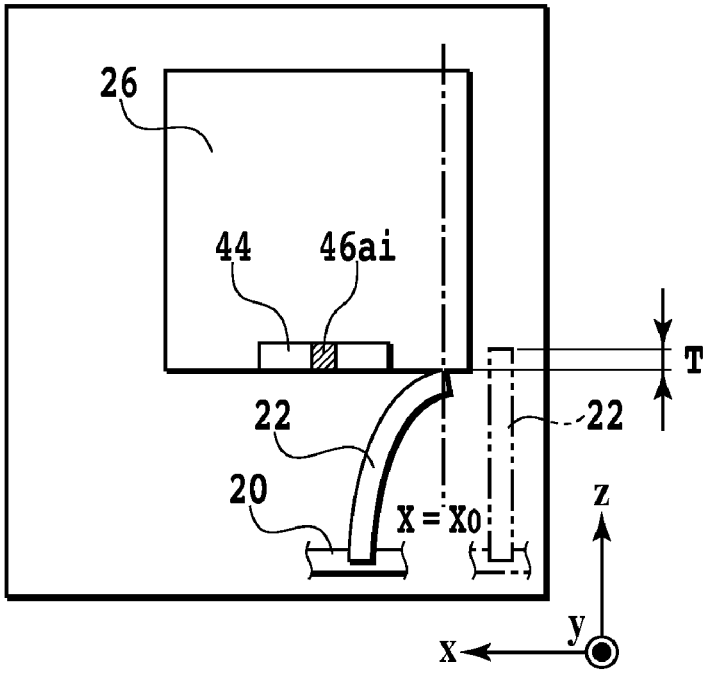
FIGS. 8A and 8B are views each made available for explaining operations in the example shown in FIG. 2.

Accordingly, as enlarged in FIG. 8A, a tip end of the elastic wiper 22 is curved and caused to approach the ink ejection opening forming surface in the first place. An amount of intrusion T at a wiping start position $X=X_0$ is set equal to 1.7 mm, for example. The amount of intrusion T is equivalent to a level difference T between a position of a tip end of the wiper 22 before the wiping processing, which is indicated with a chain double dashed line, and a position of the ink ejection opening forming surface of the print head 44 shown in FIG. 8A. The predetermined moving velocity V is set to 5 inch/s, for example.

Figure 8B:
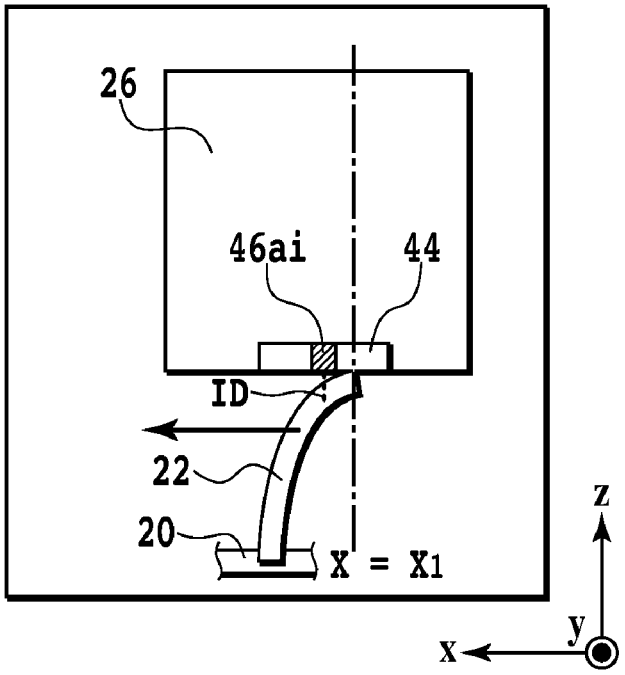

Next, the tip end of the wiper 22 reaches a predetermined position $X_1$ in FIG. 8B, which is located between the starting position $X_0$, and a position in the vicinity of the ink ejection opening 46*ai*. At that time, the control unit 50 forms preliminary ejection control data DP so as to cause the print head 44 to perform preliminary ejection toward the tip end of the wiper 22 until the tip end of the wiper 22 passes through the ink ejection opening array 46Ai. The control unit 50 supplies the preliminary ejection control data DP to the head drive control circuit 72. In this way, the head drive control circuit 72 forms a drive pulse signal having a predetermined ejection frequency and supplies the drive pulse signal to the print head 44. Therefore, the print head 44 is configured to eject just 2500 shots (hereinafter referred to as the number of ink ejections or more simply to the number of ejections) of the ink droplets ID each having a predetermined ink ejection amount (volume) such as 5 pl.

An example of the wet wiping processing program to be executed by the above-described control unit 50 when the control unit 50 is formed of a microcomputer, for instance, will be described with reference to a flowchart shown in FIG. 9.

In step SB1, the control unit 50 causes the wiper 22 at the wiping start position $X=X_0$ with the amount of intrusion T to touch to a the ink ejection opening forming surface of the print head 44 and then the process goes to step SB2. Next, in step SB2, the control data DR are formed so as to move the wiper 22 at the moving velocity V in a +X coordinate axis direction which is orthogonal to the arrangement direction of the multiple ink ejection opening arrays 46Ai, and then the control unit 50 supplies the control data DR to the recovery system control circuit 68. In step SB3 subsequent to step SB2, the control unit 50 forms the preliminary ejection control data DP so as to start ejection of the preliminary ejection at the predetermined position $X=X_1$ in front of the point where the wiper 22 passes through the ink ejection opening array 46Ai, and supplies the preliminary ejection control data DP to the head drive control circuit 72. In subsequent step SB4, the control unit 50 stops supplying the preliminary ejection control data DP immediately after the tip end of the wiper 22 passes through the ink ejection opening array 46Ai and thereby terminates the ink ejection. Then, in step SB5, the control unit 50 stops the movement of the wiper 22 in the above-described +X coordinate axis direction and thereby terminates the wet wiping processing.

The inventor of the invention verified cleaning performances after the above-described wet wiping processing was performed on the print head 44.

The inventor confirmed performances of the wet wiping processing for removing the viscosity ink and the paper fluff (dust) adhering to the ink ejection opening forming surface.

Figure 5B:
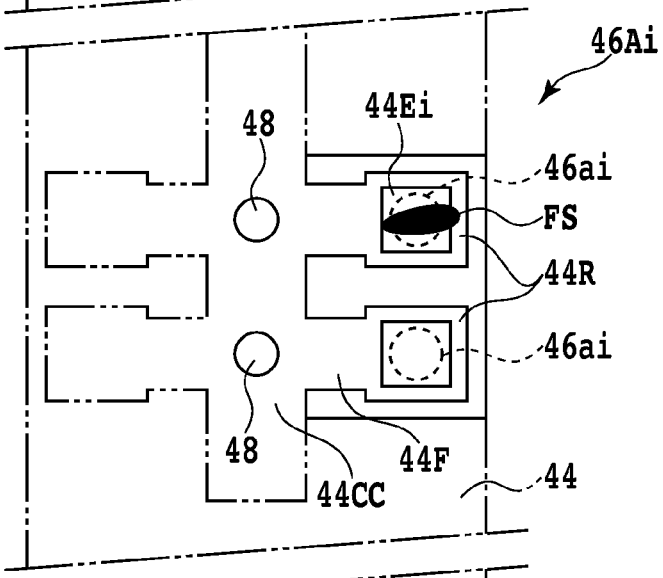

As shown in FIG. 5B, the print head 44 to be verified is assumed to include the viscosity ink FS adhering to the vicinity of the ink ejection openings 46*ai*. The viscosity ink FS adheres to only two ink ejection openings 46*ai* out of eight ink ejection openings 46*ai* constituting the ink ejection opening array 46Ai. However, no air bubbles are generated inside the ink ejection openings. The above-described wet wiping processing was carried out on the print head 44 in this state.

As a result, it was confirmed that the viscosity ink FS was completely removed.

However, there may be also cases where the cap 14 is detached for a relatively long time because there are many print sheets PA printed by use of the print head 44. In this case, as shown in Table 1 it was confirmed that, when the viscosity ink FS adheres to all of the eight ink ejection openings 46*ai*, then all the viscosity ink FS was not successfully removed by one cleaning operation in accordance with the above-described wet wiping processing.

Table 1 shows results of recovery effects in the case where the viscosity ink FS adheres to all of the eight ink ejection openings 46*ai* of the ink ejection opening array 46Ai, the recovery effects obtained while the number of times of cleaning operations in accordance with the above-described wet wiping processing is changed. On Table 1, a symbol ○ (circle) means that the viscosity ink is removed completely. Meanwhile, a symbol X means that the viscosity ink is not removed completely.

TABLE 1

| | Number of Times of Wet-Wiping Operations | | | | |
|---|---|---|---|---|---|
| | 0 | 1 | 2 | 4 | 6 |
| Effect | x | x | ○ | ○ | ○ |

As apparent from the results, it is confirmed that the viscosity ink is not removed completely by not cleaning or cleaning just once in accordance with the wet wiping processing but the removal effect of the viscosity ink FS is improved by increasing the number of times of cleaning operations.

In this embodiment, the wiper 22 is moved in the x coordinate axis direction which is orthogonal to the arrangement direction of the ink ejection opening array. However, the present invention is not limited only to this configuration and it is also possible to achieve a similar effect to remove the viscosity ink FS by moving the wiper 22 in the y coordinate axis direction which is parallel to the arrangement direction of the ink ejection openings.

Moreover, although the wiper 22 is moved in this embodiment, the present invention is not limited only to this configuration. It is also possible to achieve a similar effect to remove the viscosity ink FS by fixing the wiper 22 while moving the print head 44 relative to the wiper 22.

Further, the inventor has confirmed whether or not the print head 44 performs printing normally by causing the print head 44 subjected to the removal of the viscosity ink FS by the above-described wet wiping process to perform printing in accordance to a predetermined printing pattern. Here, the printing pattern which allows confirmation of ejection and ejection failure of the respective ink ejection openings was used.

Figure 5C:
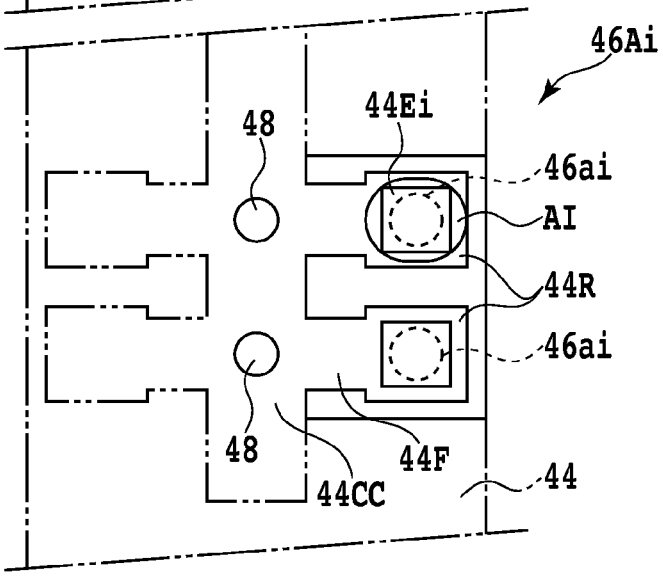

As a result, it was confirmed that more than one ink ejection openings failed to perform ejection after the above-described wet wiping processing due to generation of air bubbles AI as shown in FIG. 5C inside the ink ejection openings 46*ai* that failed to perform ejection.

Subsequently, the control unit 50 executes the bubble removal processing program in step SA2 in FIG. 1. Now, an example of the bubble removal processing program to be executed by the above-described control unit 50, when the control unit 50 is formed of the microcomputer, for instance, will be described with reference to a flowchart shown in FIG. 10.

The control unit 50 starts execution of the bubble removal processing program consecutively based on a termination signal for the above-described wet wiping processing from the recovery control circuit 68.

Figure 10:
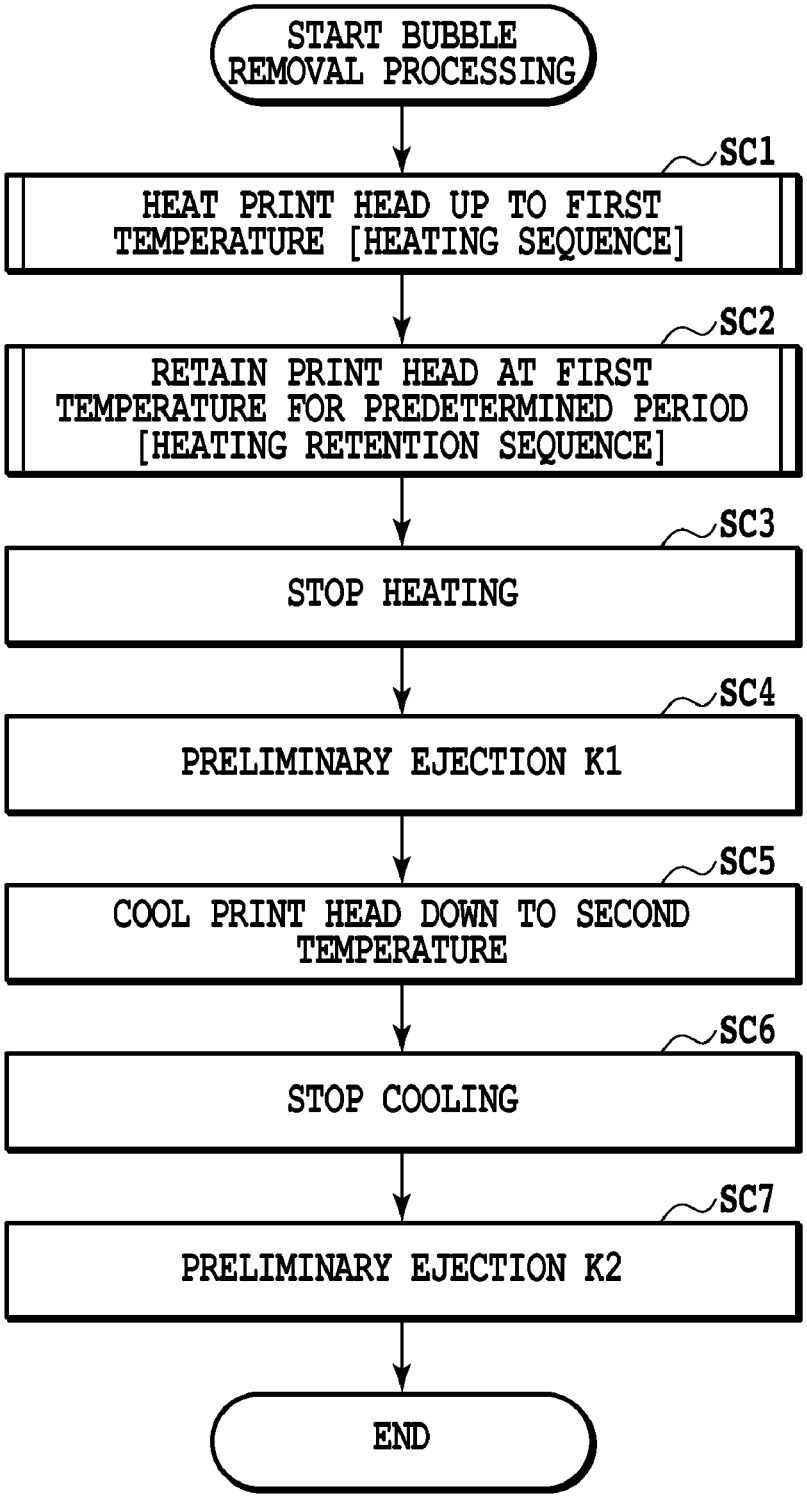
FIG. 10 is a flowchart showing an example of a program to be executed by a control unit in bubble removal processing in the example shown in FIG. 2 when the control unit is formed of a microcomputer, for example.

In FIG. 10, the control unit 50 executes a heating sequence program to be described later concerning the electrothermal conversion element 44Ei in the print head 44 in step SC1. Then the process goes to step SC2. In step SC2, a heating retention sequence program to be described later is executed on the print head 44 for a period of 5 seconds, for example. Then, the supply of the control data DH to the head temperature control circuit 70 is stopped in step SC3 in order to stop heating the print head 44.

In subsequent step SC4, the control unit 50 forms the preliminary ejection control data DP in order to cause the print head 44 to perform a preliminary ejecting operation K1 (a first preliminary ejecting operation) at a heating set temperature, which is a first set temperature immediately after the heating is stopped. The control unit 50 supplies the preliminary ejection control data DP to the head drive control unit 72 and then the process goes to step SC5. In step SC5, the control unit 50 forms the control data DH so as to cool the print head 44 to a second set temperature (a temperature for executing a preliminary ejecting operation K2 (a second preliminary ejecting operation) to be described later) lower than the first set temperature, or down to 50° C., for example, based on the detection output signal from the diode sensor 82 that detects the temperature. The control unit 50 supplies the control data DH to the head temperature control circuit 70 and then the process goes to step SC6.

In subsequent step SC6, the control unit 50 stops cooling the print head 44 when the temperature of the print head 44 reaches the second set temperature, and then the process goes to step SC7. In step SC7, the control unit 50 forms the preliminary ejection control data DP in order to execute the preliminary ejecting operation K2 when the temperature of the print head 44 is decreased to the second set temperature. The control unit 50 supplies the preliminary ejection control data DP to the head drive control circuit 72 and then terminates this program.

Here, when cooling down the print head 44 by unit of cooling by itself, such a cooling by itself operation is not artificially stopped. However, if the print head 44 is cooled down by using separate cooling unit, it is necessary to perform an operation to stop cooling by the cooling unit.

An example of the above-described heating sequence program to be executed by the control unit 50, when the control unit 50 is formed of the microcomputer, for instance, will be described with reference to a flowchart shown in FIG. 11.

The heating sequence program is the heating sequence designed to apply a short pulse drive signal to the electrothermal conversion element 44Ei of the print head 44 till the heating set temperature and thereby to increase the temperature of the print head 44.

After starting the heating sequence program, the control unit 50 resets a roop counter Roop_Heat (to 0) in step SD1 and the process goes to step SD2. The detection output signal ST from the diode sensor 82 is captured in step SD2 and the process goes to step SD3. In step SD3, a judgment is made as to whether or not the temperature of the print head 44 is higher than the heating set temperature (the first set temperature). In step SD3, if the temperature of the print head 44 is lower than the heating set temperature (the first set temperature) or 90° C., for example, the process goes to step SD4 and the short pulse drive signal is supplied to the electrothermal conversion element 44Ei of the print head 44 for a predetermined period such as 270 [ms] (Time_Heat) so as to execute heating of the print head 44. Then the process goes to step SD5. In step SD5, the control unit 50 stands by for a predetermined period such as 30 [ms] in order to accurately monitor the temperature increase in the print head 44. Then the process goes to step SD6. In step SD6, the roop counter Roop_Heat is compared with a maximum roop counter Roop_HeatMax. The program is terminated if a judgment is made that Roop_Heat >Roop_HeatMax holds true.

Meanwhile, the program is terminated if the temperature of the print head 44 is judged to be higher than the heating set temperature (the first set temperature) in step SD3.

Moreover, the process goes to step SD7 if a judgment is made in step SD6 that Roop_Heat>Roop_HeatMax does not hold true. The roop counter Roop_Heat is incremented by one and then the process returns to step SD2. The respective steps after step SD2 are executed similarly to the steps described above.

Figure 12:
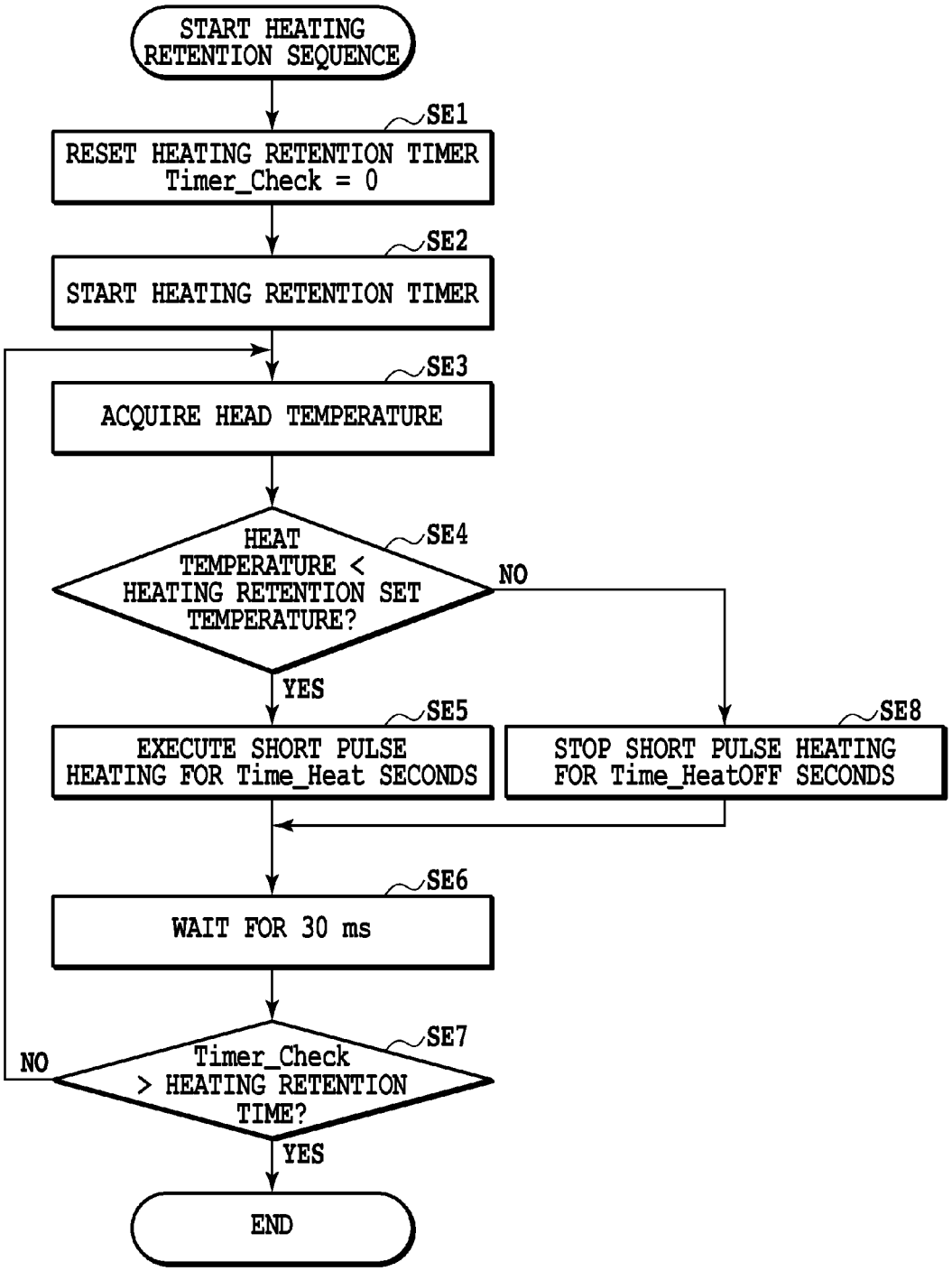
FIG. 12 is a flowchart showing an example of a program to be executed by the control unit in a heating retention sequence in the example shown in FIG. 2 when the control unit is formed of the microcomputer, for example.

Subsequently, an example of the above-described heating retention sequence program to be executed by the control unit 50, when the control unit 50 is formed of the microcomputer, for instance, will be described with reference to a flowchart shown in FIG. 12.

After starting the heating retention sequence program for retaining the first temperature for a certain period of time, the control unit 50 resets a heating retention timer Timer_Check (Timer_Check=0) in step SE1 and the process goes to step SE2. The heating retention timer is started in step SE2 and the process goes to step SE3. The detection output signal ST is captured in step SE3, and a judgment is made in subsequent step SE4 as to whether or not the temperature of the print head 44 is higher than a heating retention set temperature. In step SE4, if the temperature of the print head 44 is lower than the heating set temperature or 90° C., for example, then the process goes to step SE5. In step SE5, the short pulse drive signal is supplied to the electrothermal conversion element 44Ei of the print head 44 for a predetermined heating execution period (Time_HeatKeep) such as 80 [ms] so as to execute heating of the print head 44. Then the process goes to step SE6. In step SE6, the control unit 50 stands by for a predetermined period such as 30 [ms] in order to accurately monitor the temperature increase in the print head 44. Then the process goes to step SE7. In step SE7, a judgment is made as to whether the measured time of the heating retention timer Timer_Check exceeds a predetermined heating retention period. The program is terminated when the measured time of the heating retention timer Timer_Check exceeds the predetermined heating retention period or 5 seconds, for example.

Meanwhile, the process goes to step SE8 when a judgment is made in step SE4 that the temperature of the print head 44 is higher than the heating set temperature or 90° C., for example. In step SE8, the supply of the drive pulse signal is stopped for a heating suspension time period Time_HeatKeep_Off [ms] and the process goes to step SE6. Thereafter, the respective steps are executed similarly to those described above.

Meanwhile, if the measured time of the heat retention timer Timer_Check does not exceed the predetermined heating retention time or 5 seconds, for example, then the process returns to step SE3 and then the reminder of the respective steps are executed similarly to those described above.

Recovery performances by the above-described bubble removal process have been verified by the inventor.

As for the print head 44 to be subjected to the bubble removal processing, the one which contains air bubbles AI inside some of the multiple ink ejection openings is used for the purpose of verification. The print head 44 in this state is subjected to the above-described heating recovery processing. Moreover, after the heating recovery processing, the printing performance of the print head is confirmed by use of this print head 44. Here, a printing pattern which allows checking of ink ejection or ejection failure from each of the ink ejection openings, as well as deflections and other defects is used.

Table 2 to Table 4 respectively show results of effects of the bubble removal processing when the ejection frequency and the number of shots of the above-described preliminary ejection K1 in the removal processing are changed. Here, the ejection frequency for the preliminary ejection K2 is set to a constant value of 15 [kHz] and the number of shots of the preliminary ejection K2 is set to a constant value of 45000 [shots] in the bubble removal processing.

On Table 2 to Table 4 shown below, a symbol ○ (circle) means that all the bubbles generated in the ink ejection opening array 46Ai are completely removed. Meanwhile, a symbol X means that the bubbles generated in the ink ejection opening array 46Ai are not completely removed.

On Table 2, the ejection frequency of the preliminary ejection K1 is set to 15 [kHz], which is equal to the ejection frequency used at the time of print operation by the print head 44. From this result, it is confirmed that the bubbles are not removed by 0 shot of the preliminary ejection K1 but the effect of the bubble removal is improved by increasing the number of shots.

As described above, the bubbles generated when the wet wiping processing for removing the viscosity ink and paper fluff (dust) adhering to a surface of nozzles (the ink ejection opening forming surface) is performed are heated to 90° C., which is the first temperature, by the heating unit using the heat generating element for ejecting the ink. At this time, the first temperature of 90° C. is retained for 5 seconds and the preliminary ejection K1 is carried out at the first temperature of 90° C. Then the bubbles are cooled down by natural radiation to the second temperature of 50° C., which is lower than the first temperature, and the second preliminary ejection K2 is carried out at the second temperature of 50° C. In this way, it is possible to provide the recovery processing method having the enhanced effect of removing, without leaving bubbles, the viscosity ink or the paper fluff (dust) adhering to the surface of nozzles (ink ejection opening forming surface).

TABLE 2

| Ejection Frequency 15 kHz | | | | | |
|---|---|---|---|---|---|
| | Number of Shots of Preliminary Ejection K1 | | | | |
| | 0 | 5000 | 7500 | 20000 | 45000 |
| Effect | x | x | x | x | ○ |

TABLE 3

| Ejection Frequency 20 kHz | | | | | |
|---|---|---|---|---|---|
| | Number of Shots of Preliminary Ejection K1 | | | | |
| | 0 | 5000 | 7500 | 20000 | 45000 |
| Effect | x | x | x | ○ | ○ |

TABLE 4

| Ejection Frequency 30 kHz | | | | | |
|---|---|---|---|---|---|
| | Number of Shots of Preliminary Ejection K1 | | | | |
| | 0 | 5000 | 7500 | 20000 | 45000 |
| Effect | x | ○ | ○ | ○ | ○ |

(1) Consideration of conditions of the preliminary ejection K1 at the first temperature Table 3 shows a result of setting the ejection frequency for the preliminary ejection K1 equal to 20 [kHz] which is higher than the ejection frequency used for printing by the print head 44, and Table 4 shows a result of setting the ejection frequency equal to 30 [kHz].

According to Table 2, it is necessary to eject 45000 shots for recovery when the ejection frequency for the preliminary ejection K1 is set equal to 15 kHz. However, as apparent from Table 3 and Table 4, it is only necessary to eject 20000 shots for removal when the ejection frequency for the preliminary ejection K1 is set equal to 20 kHz. Moreover, it is only necessary to eject 5000 shots for removal when the ejection frequency for the preliminary ejection K1 is set equal to 30 kHz. Therefore, it is confirmed that the effect to remove bubbles is improved even with a smaller number of shots by gradually increasing the ejection frequency for the preliminary ejection K1.

As described above, the ejection frequency for the preliminary ejection K1 to be carried out at the first temperature of 90° C. is set higher than the ejection frequency to be applied when printing with the print head 44 is performed. In this way, it is possible to enhance the effect to remove bubbles located at the tip ends of the ink ejection openings by ejecting a smaller number of shots in the preliminary ejection K1.

(2) Consideration of Conditions of the Preliminary Ejection K2 at the Second Temperature While the ejection frequency for the preliminary ejection K2 is set to 15 [kHz] and the number of shots is set to 45000 [shots] in the above-described section (1), another case of changing the ejection frequency and the number of shots of the preliminary ejection will be described herein. The heating recover processing aims at confirmation of the recovery performance of the bubble recovery processing.

There are air bubbles AI inside some of the multiple ink ejection openings of the print head 44 to be subjected to the bubble removal processing for the purpose of verification. The print head 44 in this state is subjected to the heating recovery processing in the course of the bubble removal processing.

Moreover, after the heating recovery processing, the printing performance is confirmed by use of this print head 44. Here, the printing pattern which allows checking of ink ejection or ejection failure from the respective ink ejection openings, as well as deflections and other defects is used.

Table 5 shows a result of an effect of the removal processing when the ejection frequency for the preliminary ejection K2 and the number of shots of the preliminary ejection are changed. Here, the ejection frequency for the preliminary ejection K1 is set to a constant value of 15 [kHz] and the number of shots of the preliminary ejection K1 is set to a constant value of 45000 [shots].

TABLE 5

| Ejection Frequency | Number of Shots of Preliminary Ejection K2 500 Shots | Number of Shots of Preliminary Ejection K2 45000 Shots |
|---|---|---|
| 5 kHz | ○ | ○ |
| 15 kHz | x | ○ |
| 30 kHz | x | x |

On Table 5, a symbol ○ (circle) means that all the bubbles generated in the ink ejection opening array 46Ai are completely removed. A symbol X means that the bubbles generated in the ink ejection opening array 46Ai are not completely removed.

As shown on Table 5, it is apparent that the recovery performance is improved by increasing the number of shots in the preliminary ejection K2 as similar to the preliminary ejection K1. However, concerning the ejection frequency, it is apparent that the recovery performance is improved by setting the lower ejection frequency than the ejection frequency used for printing with the print head 44, which is contrary to the case of the preliminary ejection K1.

As described above, the ejection frequency for the preliminary ejection K2 to be carried out at the second temperature of 50° C. is set equal to or less than the ejection frequency to be applied when printing with the print head 44 is performed. In this way, it is possible to enhance the effect to remove bubbles located at the tip ends of the ink ejection openings by ejecting a smaller number of shots in the preliminary ejection K2.

(3) Consideration of Retention Time

The heating retention time is set equal to 5 [sec] in the above-described sections (1) and (2). Now, a case of changing the heating retention time will be described.

In this heating recovery processing, the recovery performance of the bubble removal processing shown in FIG. 10 is confirmed. There are bubbles AI inside some of the multiple ink ejection openings of the print head 44. The print head 44 in this state is subjected to the heating recovery processing. Moreover, after the heating recovery processing, the printing performance of the print head is confirmed by use of this print head 44. The printing pattern which allows checking of ink ejection or ejection failure from the respective ink ejection openings, as well as deflections and other defects is used.

Table 6 shows a result of an effect of the removal processing when the ejection frequency for the preliminary ejection K1 and the number of shots of the preliminary ejection are changed. Here, the ejection frequency for the preliminary ejection K1 is set to a constant value of 15 [kHz]. The ejection frequency for the preliminary ejection K2 is set to a constant value of 15 [kHz] and the number of shots of the preliminary ejection K2 is set to a constant value of 45000 [shots].

TABLE 6

| Heating | Number of Shots of Preliminary Ejection K1 | | | | |
|---|---|---|---|---|---|
| Retention Time (s) | 0 Shot | 7500 Shots | 20000 Shots | 45000 Shots | 60000 Shots |
| 0 | x | x | x | x | ○ |
| 5 | x | x | x | ○ | ○ |
| 10 | x | x | ○ | ○ | ○ |

On Table 6, a symbol ○ (circle) means that all the bubbles generated in the ink ejection opening array 46Ai are completely removed. Meanwhile, a symbol X means that the bubbles generated in the ink ejection opening array 46Ai shown in FIG. 4 are not completely removed. From this result, it is confirmed that the recovery performance is improved by a smaller number of shots when setting the longer heating retention time.

As described above, it is possible to enhance the effect to remove bubbles located at the tip ends of the ink ejection openings with a smaller number of shots by heating to the first temperature of 90° C. by the heating unit, increasing the retention time at the first temperature, and then performing the preliminary ejection at the first temperature. Moreover, as previously described in conjunction with the section (1), it is possible to achieve recovery with an even smaller number of shots by setting the higher ejection frequency for the preliminary ejection K1.

(4) Consideration of Heating Set Temperature

While the heating set temperature being the first temperature is set to 90[° C.] in the above-described sections (1) to (3), another case of changing the heating set temperature being the first temperature will now be described herein.

In the heating recovery processing, the recovery performance of the bubble removal processing shown in FIG. 10 is confirmed. There are bubbles AI inside some of the multiple ink ejection openings 46*ai* in the ink ejection opening array 46Ai of the print head 44. The print head 44 in this state is subjected to the above-described heating recovery processing.

After the heating recovery processing, the printing performance is confirmed by use of this print head 44. The printing pattern which allows checking of ink ejection or ejection failure from each of the ink ejection openings, as well as deflections and other defects is used.

TABLE 7

| | Number of Shots of Preliminary Ejection K1 | | | | |
|---|---|---|---|---|---|
| Temperature ° C. | 0 Shot | 7500 Shots | 20000 Shots | 45000 Shots | 60000 Shots |
| 120 | ○ | ○ | ○ | ○ | ○ |
| 100 | x | x | ○ | ○ | ○ |
| 90 | x | x | x | ○ | ○ |
| 80 | x | x | x | x | ○ |

TABLE 8

| | Number of Shots of Preliminary Ejection K2 | | | | |
|---|---|---|---|---|---|
| Temperature ° C. | 0 Shot | 7500 Shots | 20000 Shots | 45000 Shots | 60000 Shots |
| 60 | x | x | x | x | ○ |
| 50 | x | x | x | ○ | ○ |
| 40 | x | x | ○ | ○ | ○ |

Table 7 and Table 8 show results of the recovery effect when the heating set temperatures and the numbers of shots of preliminary ejection in the preliminary ejection K1 and the preliminary ejection J2 are changed. On Table 7 to Table 8 shown below, a symbol ○ (circle) means that all the bubbles generated in the ink ejection opening array 46Ai are completely removed. Meanwhile, a symbol X means that the bubbles generated in the ink ejection opening array 46Ai are not completely removed.

Table 8 shows a result of an effect of the removal processing when the heating set temperature of the preliminary ejection K1 and the number of shots of the preliminary ejection are changed. However, the ejection frequency for the preliminary ejection K1 is set to a constant value of 15 [kHz]. In addition, the second temperature applied to execution of the preliminary ejection K2 is set equal to 50° C., while the ejection frequency is set to a constant value of 15 [kHz] and the number of shots is set to a constant value of 45000 [shots].

As apparent from Table 7, it is necessary to eject 45000 shots to achieve removal when the heating set temperature is equal to 90° C.

Meanwhile, it is possible to reduce the number of shots to 20000 shots to achieve removal when the heating set temperature is equal to 100° C. whereas the required number of shots for removal is increased to 60000 shots when the heating set temperature is equal to 80° C. Accordingly, it is confirmed that the recovery can be achieved by a smaller number of shots by setting the higher heating set temperature for carrying out the preliminary ejection K1 while increasing a difference between the heating set temperature for carrying out the preliminary ejection K1 and the second temperature for carrying out the preliminary ejection K2.

Moreover, when the heating set temperature is equal to 120° C., it is also confirmed that a similar effect can be obtained by setting the number of shots in the preliminary ejection K1 equal to 0, i.e., by carrying out the heating recovery processing while omitting the preliminary ejection K1.

Meanwhile, Table 8 shows a result of an effect of the removal processing when the heating set temperature of the preliminary ejection K2 and the number of shots of the preliminary ejection are changed. Here, the ejection frequency for the preliminary ejection K2 is set to a constant value of 15 [kHz]. In addition, the first temperature applied to execution of the preliminary ejection K1 is set equal to 90° C., while the ejection frequency is set to a constant value of 15 [kHz] and the number of shots is set to a constant value of 45000 [shots].

As apparent from Table 8, it is necessary to eject 45000 shots to achieve removal when the heating set temperature is equal to 50° C.

However, it is possible to reduce the number of shots to 20000 shots to achieve removal when the heating set temperature is equal to 40° C. whereas the required number of shots for recovery is increased to 60000 shots when the heating set temperature is equal to 60° C. Accordingly, it is confirmed that the recovery can be achieved by a smaller number of shots by setting the lower heating set temperature for carrying out the preliminary ejection K2 while increasing a difference between the heating set temperature for carrying out the preliminary ejection K2 and the second temperature for carrying out the preliminary ejection K1.

As described above, the first temperature is set higher by use of the heating unit and then the preliminary ejection is carried out at the first temperature, and meanwhile, the second temperature is set lower when cooling down and then the preliminary ejection is carried out at the second temperature. By increasing the difference between the first temperature and the second temperature, it is possible to enhance the effect to remove air bubbles located at the tip ends of the ink ejection openings by setting a smaller number of shots.

(5) Consideration of Heating Unit

In this example, the recovery performance by the bubble removal processing shown in FIG. 10 is confirmed by using a configuration which comprises the heating board provided with the heat generating element 46H for heating the print head 44, i.e., a heat-retention heater for adjusting the temperature of the print head.

There are bubbles AI inside some of the ink ejection openings out of the multiple ink ejection openings constituting the ink ejection opening array 46Ai of the print head 44 to be subjected to the bubble removal processing. The print head 44 in this state is subjected to the heating recovery processing. Moreover, the printing performance of the print head is confirmed by use of this print head 44. The printing pattern which allows checking of ink ejection or ejection failure from the respective ink ejection openings, as well as deflections and other defects is used.

Figure 11:
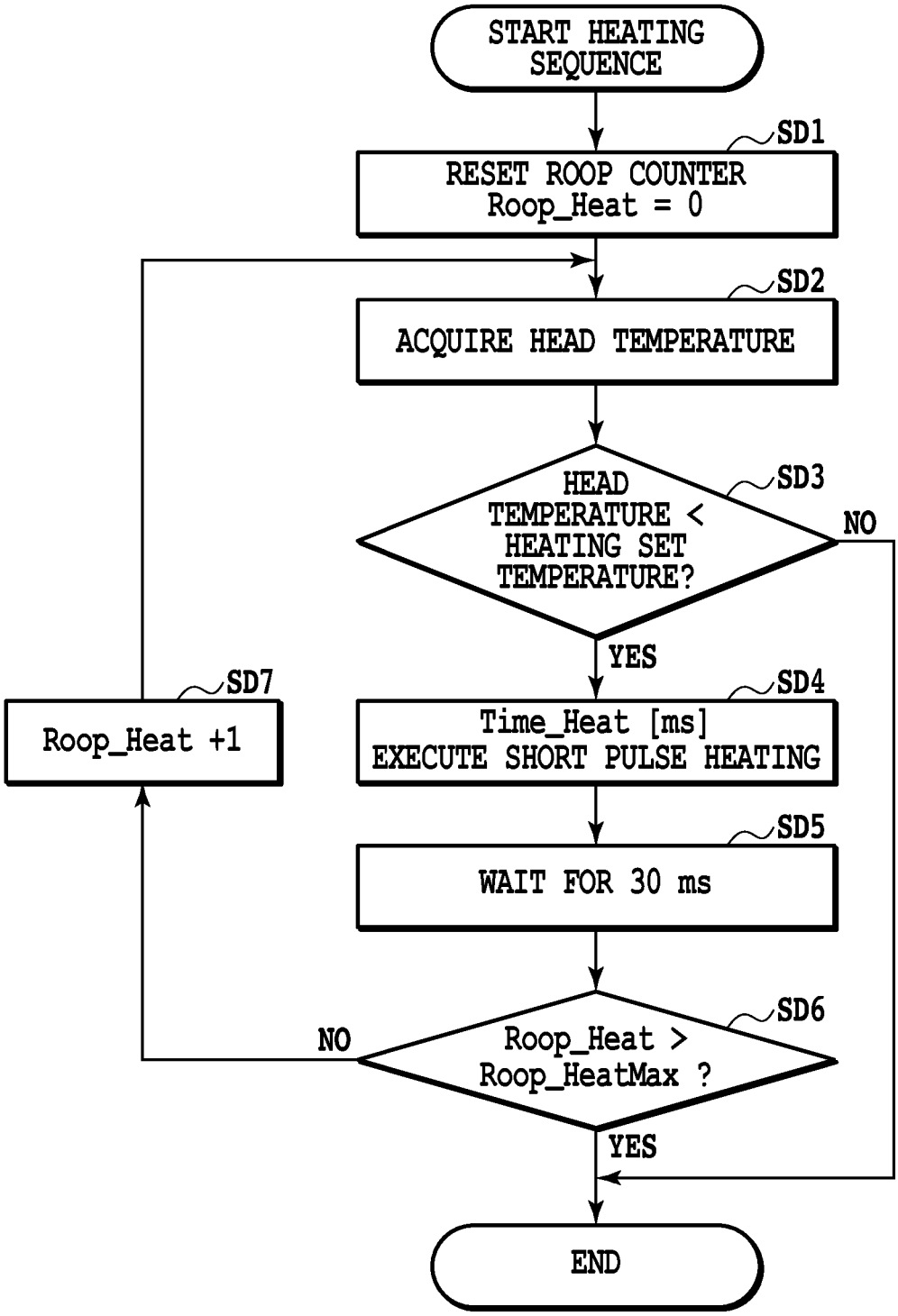
FIG. 11 is a flowchart showing an example of a program to be executed by the control unit in a heating sequence in the example shown in FIG. 2 when the control unit is formed of the microcomputer, for example.

Upon consideration of the heating unit, in the above-described example, the short pulse drive signal is supplied to the electrothermal conversion element 44Ei of the print head 44 for the predetermined period so as to heat the print head 44 as shown in FIG. 11. Instead, as shown in FIG. 12 and FIG. 13, the print head 44 is heated by supplying a drive signal pulse to the heat generating element 46H which is configured to heat the print head 44.

Figure 13:
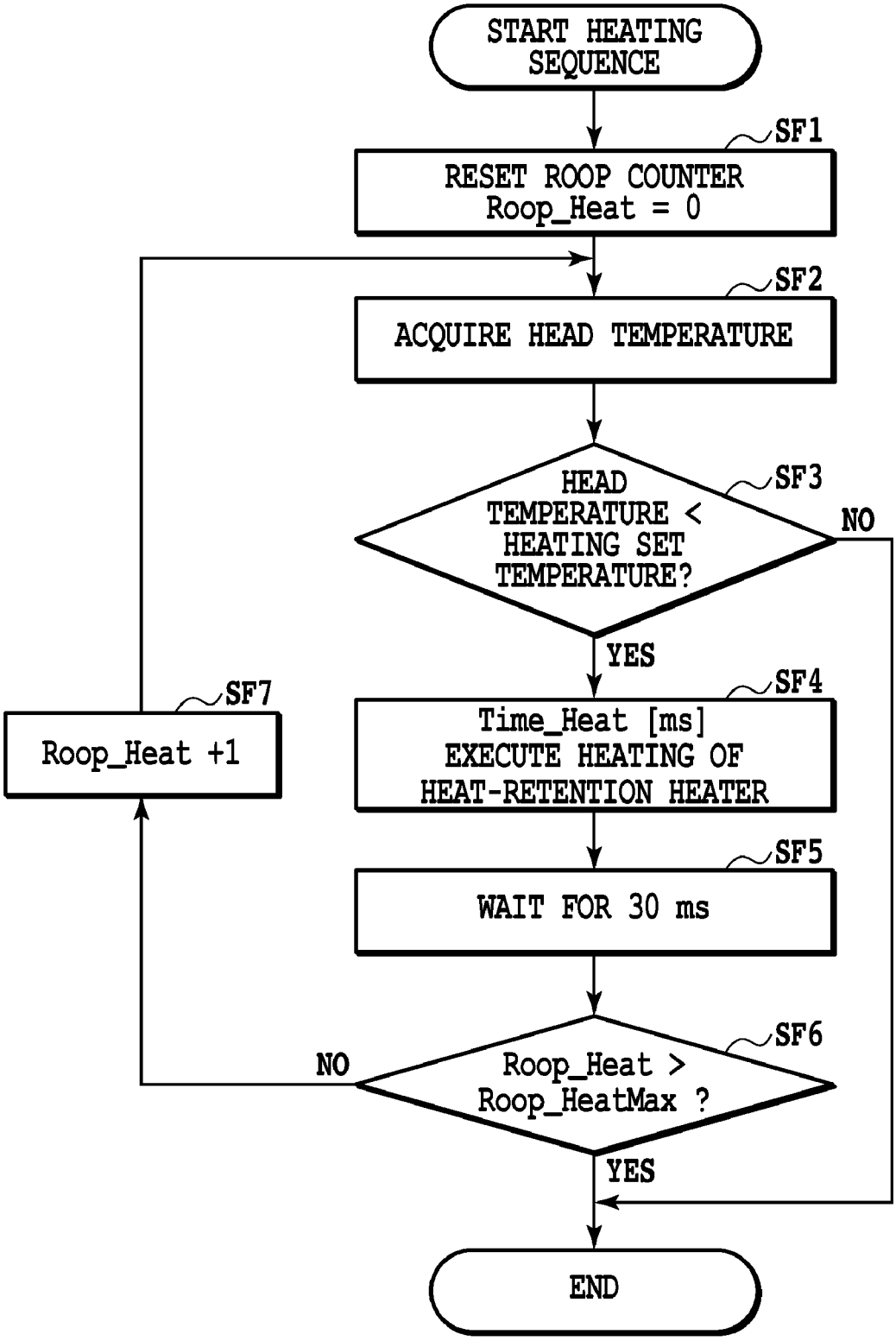
FIG. 13 is a flowchart showing an example of a program to be executed by the control unit in a heating sequence using the heat generating element in the example shown in FIG. 2 when the control unit is formed of the microcomputer, for example.

In FIG. 13, the heating sequence program is the heating sequence designed to supply a drive pulse signal to the heat generating element 46H of the print head 44 to increase the temperature of the print head 44 to the heating set temperature.

After starting the heating sequence program, the control unit 50 resets the roop counter Roop_Heat (to 0) in step SF1 and the process goes to step SF2. The detection output signal ST from the diode sensor 82 is captured in step SF2. In subsequent step SF3, a judgment is made as to whether or not the temperature of the print head 44 is higher than the heating set temperature (the first set temperature). In step SF3, if the temperature of the print head 44 is lower than the heating set temperature (the first set temperature) or 90° C., for example, the process goes to step SF4 and the drive pulse signal is supplied to the heat generating element 46H of the print head 44 for a predetermined period such as 270 [ms] (Time_Heat) so as to execute heating of the print head 44. Then the process goes to step SF5. In step SF5, the control unit 50 stands by for a predetermined period such as 30 [ms] in order to accurately monitor the temperature increase in the print head 44. Then the process goes to step SF6. In step SF6, the roop counter Roop_Heat is compared with the maximum roop counter Roop_HeatMax. The program is terminated if a judgment is made that Roop_Heat>Roop_HeatMax holds true.

Meanwhile, the program is terminated if the temperature of the print head 44 is judged to be higher than the heating set temperature (the first set temperature) in step SF3.

Moreover, the process goes to step SF7 if a judgment is made in step SF6 that Roop_Heat>Roop_HeatMax does not hold true. The roop counter Roop_Heat is incremented (+1) and then the process returns to step SF2. The respective steps after step SF2 are executed similarly to the steps described above.

Figure 14:
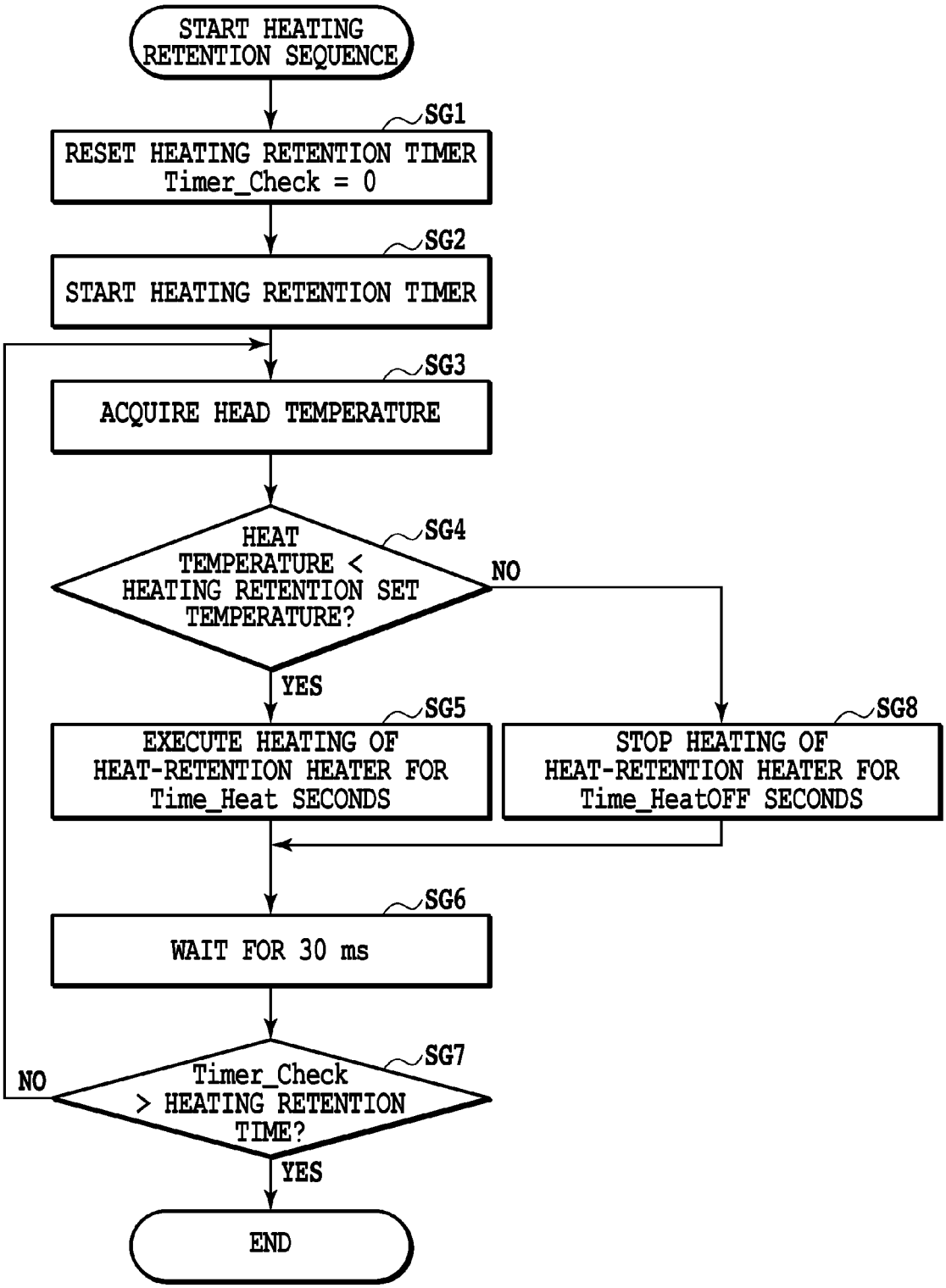
FIG. 14 is a flowchart showing an example of a program to be executed by the control unit in a heating retention sequence applying the heat generating element in the example shown in FIG. 2 when the control unit is formed of the microcomputer, for example.

Subsequently, an example of the above-described heating retention sequence program to be executed by the control unit 50, when the control unit 50 is formed of the microcomputer, for instance, will be described with reference to a flowchart shown in FIG. 14.

After starting the heating sequence program, the control unit 50 resets the heating retention timer Timer_Check (Timer_Check=0) in step SG1 and the process goes to step SG2.

The heating retention timer is started in step SG2 and the process goes to step SG3. The detection output signal ST is captured in step SG3, and a judgment is made in subsequent step SG4 as to whether or not the temperature of the print head 44 is higher than the heating retention set temperature. In step SG4, if the temperature of the print head 44 is judged to be lower than the heating set temperature or 90° C., for example, then the process goes to step SG5. In step SG5, the drive pulse signal is supplied to the heat generating element 46H of the print head 44 for the predetermined heating execution period (Time_HeatKeep) such as 80 [ms] so as to execute heating of the print head 44. Then the process goes to step SG6. In step SG6, the control unit 50 stands by for a predetermined period such as 30 [ms] in order to accurately monitor the temperature increase in the print head 44. Then the process goes to step SG7. In step SG7, a judgment is made as to whether the measured time of the heating retention timer Timer_Check exceeds a predetermined heating retention period. As a result of the judgment, the program is terminated when the measured time of the heating retention timer Timer_Check exceeds the predetermined heating retention period or 5 seconds, for example.

Meanwhile, the process goes to step SG8 when a judgment is made in step SG4 that the temperature of the print head 44 is higher than the heating set temperature or 90° C., for example. In step SG8, the supply of the drive pulse signal is stopped for the heating suspension time period Time_HeatKeep_Off [ms] and the process goes to step SG6. Thereafter, the respective steps are executed similarly to those described above.

Meanwhile, in step SG7, if the measured time of the heat retention timer Timer_Check does not exceed the predetermined heating retention time or 5 seconds, for example, then the process returns to step SG3 and then the reminder of the respective steps are executed similarly to those described above.

It is confirmed that the bubble removal processing can be executed after the wet wiping processing even in the case of heating the print head 44 by supplying the drive pulse signal to the heat generating element 46H for heating the print head 44. Therefore, bubble removing unit comprises either the electrothermal conversion element 44Ei or the heat generating element 46H to be controlled by the control unit 50, and the diode sensor 82. In this way, it is possible to enhance the effect to remove the viscosity ink and the paper fluff (dust) adhering to the ink ejection opening forming surface without leaving any bubbles.

(Second Embodiment)

Figure 15:
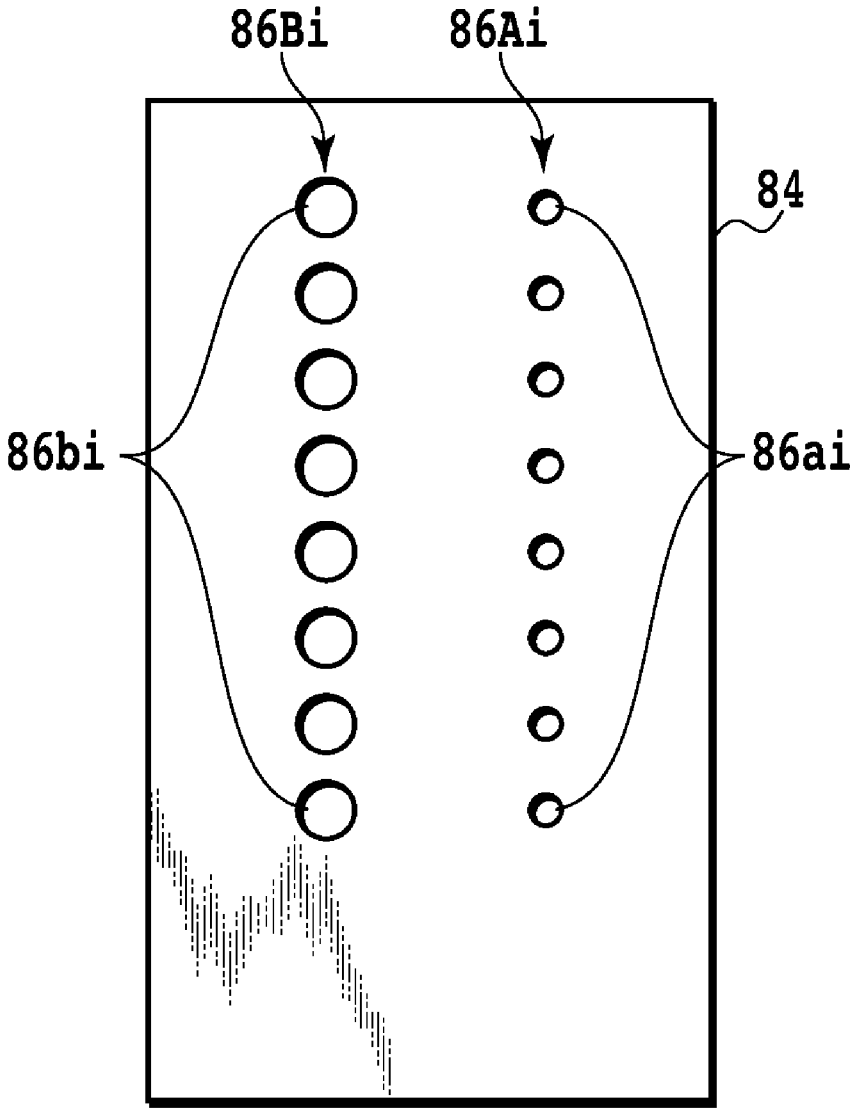
FIG. 15 is a partial enlarged plan view showing a part of a print head in a head ink cartridge to which a second embodiment of the recovery processing method for a print head according to the present invention is applied.
Figure 16:
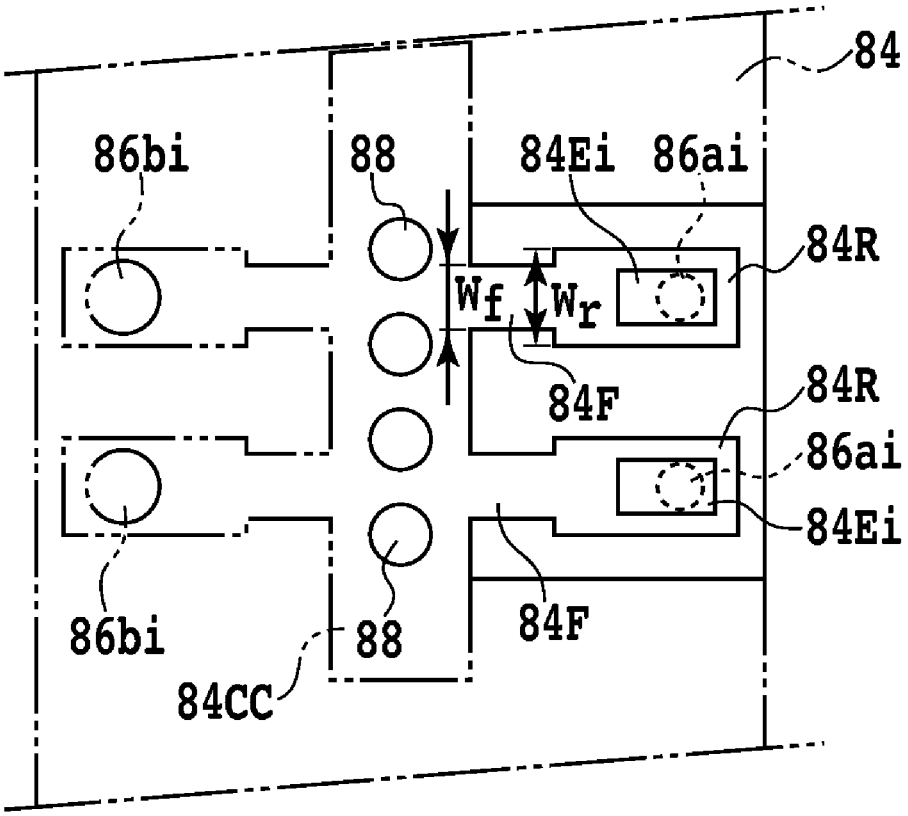
FIG. 16 is a partial enlarged cross-sectional view showing a part of the print head in the head ink cartridge illustrated in FIG. 15.

FIG. 15 and FIG. 16 show principal part of a printing element board to which a second embodiment of the recovery processing method for a print head according to the present invention is applied.

The printing element board includes a board made of silicon (Si) and provided with a thin film on a surface thereof, and an orifice plate to be formed on the board, for example.

The above-described board made of silicon (Si) is formed so as to define ink supply ports serving as flow paths for the inks in the respective colors. Here, the ink supply ports are formed of long-groove through holes which are integrally opened almost at the center on a rear surface. As partially enlarged and illustrated in FIG. 16, multiple electrothermal conversion elements 84Ei (i=1 to 8) are arranged and formed on each line so as to face one another along a peripheral edge in a longitudinal direction of the ink supply ports.

Bubble generating chambers 89R, ink flow path walls, and ink ejection openings 86*ai* and 86*bi* (i=1 to 8) are formed in accordance with a photolithographic technique on the orifice plate to be formed on the board. The expansion chambers 84R correspond to the respective electrothermal conversion elements 84Ei. The ink flow path walls form respective ink flow paths 84F for communicating the respective expansion chambers 84R with a common liquid chamber 84CC. Accordingly, the adjacent ink ejection openings 86*ai* and the adjacent expansion chambers 84R, as well as the adjacent ink ejection openings 86*bi* and the adjacent expansion chambers 84R are partitioned by the ink flow path walls.

Multiple filters 88 are provided in the common liquid chamber 84CC for the purpose of trapping dusts if the dusts are included in the ink supplied from the ink supply ports, the common liquid chamber 84CC communicated with the ink supply ports.

A single array of the ink ejection opening array 86Ai formed of the ink ejection openings 86*ai* is formed in a moving direction of the printing element board, i.e., in a direction substantially orthogonal to the direction along the x coordinate axis in FIG. 2 so as to correspond to the array of the electrothermal conversion elements 84Ei. Meanwhile, a single array of the ink ejection opening array 86Bi formed of the ink ejection openings 86*bi* is formed in the moving direction of the printing element board, i.e. in the direction substantially orthogonal to the direction along the x coordinate axis in FIG. 2 so as to correspond to the array of the electrothermal conversion elements 84Ei.

Each ink ejection opening 86*ai* is made of a circular hole having a cross-sectional area capable of ejecting an ink droplet equal to 2 pl, for example, or in a diameter of 10.4 μm to be more precise. Dimensions of the expansion chambers 84R, the ink flow paths 84F, and the electrothermal conversion elements 84Ei communicated with the respective ink ejection openings 86*ai* are adjusted appropriately. To be more precise, a width Wr of each side of the expansion chamber 84R is set equal to 22 (μm) while a width Wf of the ink flow path 84F is set equal to 11 (μm). The shape of the electrothermal conversion element 84Ei is a rectangle having dimensions of 13×22.4 (μm).

Each ink ejection opening 86*bi* is made of a circular hole having a cross-sectional area capable of ejecting an ink droplet equal to 5 pl, for example, or in a diameter of 16.4 μm to be more precise. Dimensions of the expansion chambers, the ink flow paths, and the electrothermal conversion elements communicated with the respective ink ejection openings 86*bi* are adjusted appropriately. To be more precise, a width Wr of each side of the expansion chamber is set equal to 29 (μm) while a width Wf of the ink flow path is set equal to 22.5 (μm). The shape of the electrothermal conversion element 84Ei is a rectangle having dimensions of 19.4×21.6 (μm). Accordingly, there are two different types of the ink ejection amounts between the two ink ejection opening arrays 86Ai and 86Bi. Specifically, a first ink ejection opening ejection opening array has the ink ejection amount different from that of a second ink ejection opening array.

An example of the wet wiping processing program to be executed by the above-described control unit 50, when the control unit 50 is formed of a microcomputer, for instance, will be described with reference to a flowchart shown in FIG. 18.

Figure 17A:
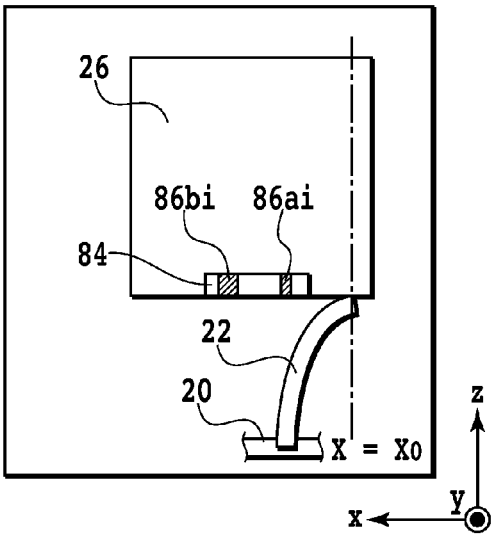
FIGS. 17A, 17B and 17C are views respectively made available for explaining operations in the second embodiment of the recovery processing method for a print head according to the present invention.
Figure 17B:
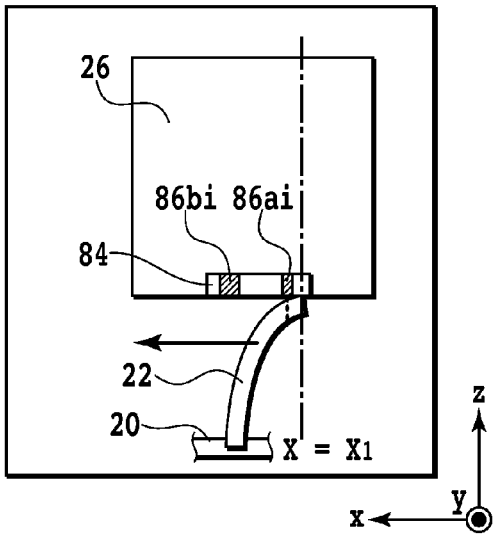
Figure 17C:
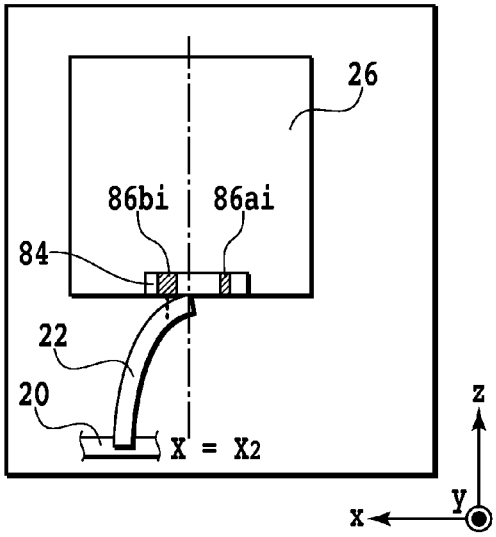

As shown in FIG. 17A, in step SH1, the control unit 50 places the wiper 22 in the wiping start position $X=X_0$ at the amount of intrusion T (1.7 mm). Next, in step SH2, the control unit 50 forms the control data DR so as to move the wiper 22 at the moving velocity V (5 inch/s) in the +x coordinate axis direction which is orthogonal to the arrangement direction of the multiple ink ejection opening arrays 86Ai and 86Bi. The control unit 50 supplies the control data DR to the recovery system control circuit 68. In step SH3 subsequent to step SH2, the control unit 50 forms the preliminary ejection control data DP so as to start the preliminary ejection in the predetermined position $X=X_1$ in front of the point where the wiper 22 passes through the ink ejection opening array 86Ai, and supplies the preliminary ejection control data DP to the head drive control circuit 72. In subsequent step SH4, the control unit 50 forms the preliminary ejection control data DP so as to start the preliminary ejection in a predetermined position $X=X_2$ in front of the point where the wiper 22 passes through the ink ejection opening array 86Bi after passing through the ink ejection opening array 86Ai. The control unit 50 supplies the preliminary ejection control data DP to the head drive control circuit 72 and then the process goes to step SH5. In step SH5, the control unit 50 stops supplying the preliminary ejection control data DP immediately after the tip end of the wiper 22 passes through the ink ejection opening array 86Ai and thereby terminates the ink ejection. Then the process goes to step SH6. In step SH6, the control unit 50 stops supplying the preliminary ejection control data DP immediately after the tip end of the wiper 22 passes through the ink ejection opening array 86Bi and thereby terminates the ink ejection. Then the process goes to step SH7. In step SH7, the control unit 50 stops the movement of the wiper 22 in the above-described +x coordinate axis direction and thereby terminates the wet wiping processing.

Cleaning performances have been verified by the inventor of the invention after performing the above-described wet wiping processing on the print head 44.

The inventor confirmed performances of the wet wiping processing for removing the viscosity ink and the paper fluff (dust) adhering to the ink ejection opening forming surface. As a result, it was confirmed that all the viscosity ink was completely removed.

However, when there was the viscosity ink in eight positions due to a reason that the cap 14 was detached for relatively a long time because there were many sheets to be printed, for example, it was not possible to remove all viscosity ink by performing only one cleaning operation in accordance with the wet wiping processing.

Table 9 shows results of recovery effects when the number of times of the cleaning operations in accordance with the wet wiping processing is changed.

TABLE 9

| Ejection | Number of Times of Wet Wiping Operations | | | | |
|---|---|---|---|---|---|
| Amount | 0 | 1 | 2 | 4 | 6 |
| 5pl | x | x | ○ | ○ | ○ |
| 2pl | x | x | x | ○ | ○ |

Here, on Table 9, a symbol ○ means that the viscosity ink existing inside the ink ejection opening array 86Ai and the ink ejection opening array 86Bi is removed completely. Meanwhile, a symbol X means that the viscosity ink existing inside the ink ejection opening array 86Ai and the ink ejection opening array 86Bi is not removed completely.

As apparent from Table 9, it is not possible to achieve recovery without performing any cleaning operations in accordance with the wet wiping processing. However, it is confirmed that the effect to remove the viscosity ink is improved by increasing the number of times of the cleaning operations.

Meanwhile, concerning the ejection opening array designed to eject about 5 pl, it is effective to carry out the cleaning operations twice or more in accordance with the wet wiping processing in order to remove the viscosity ink.

However, concerning the ejection opening array 86Ai designed to eject about 2 pl, the cleaning operations need to be carried out at least four times in accordance with the wet wiping processing in order to remove the viscosity ink. That is to say, it is confirmed that the number of times of the cleaning operations in accordance with the wet wiping processing necessary for removing the viscosity ink substance tends to increase when the ejection openings have smaller diameters.

Here, the wiper 22 is moved in the x coordinate axis direction which is orthogonal to the arrangement direction of the ink ejection opening arrays. However, the present invention is not limited only to this configuration and it is also possible to achieve a similar effect to remove the viscosity ink by moving the wiper 22 in the y coordinate axis direction which is parallel to the arrangement direction of the ink ejection openings. Moreover, although the wiper 22 is moved in this embodiment, the present invention is not limited only to this configuration. It is also possible to achieve a similar effect to remove the viscosity ink by moving the print head instead.

Further, the inventor has confirmed the printing performance by using this print head. Here, a printing pattern which allows checking of ink ejection or ejection failure from each of the ink ejection openings was used.

As a result, ejection failures were found in the multiple ink ejection openings on the ink ejection opening array 86Ai as well as in the multiple ink ejection openings on the ink ejection opening array 86Bi. It was also confirmed that bubbles AI similar to the one illustrated in FIG. 5C were generated inside the ink ejection openings which failed to perform ejection.

The recovery performance attributable to the bubble removal processing was also confirmed in this embodiment as shown in FIG. 10. As a result, the bubbles were generated inside the ink ejection openings 86*ai* and the ink ejection openings 86*bi* as similar to the first embodiment.

Subsequently, the bubble removal processing as shown in FIG. 10 was performed. Moreover, the printing performance of this print head was confirmed. A printing pattern which allows checking of ink ejection, ejection failure, deflections, and the like of each of the ink ejection openings was used.

Table 10 shows effects of the bubble removal when the number of shots of preliminary ejection in the preliminary ejection K1 for one of the ink ejection opening arrays 86Bi designed for 5 pl and the other ink ejection opening array 86Ai designed for 2 pl is changed in this embodiment. It is to be noted, however, that the number of shots of the preliminary ejection K1 is fixed to the same number between the ink ejection opening array 86Ai and the ink ejection opening array 86Bi. Moreover, the ejection frequency for the preliminary ejection K2 is set to a constant value of 15 [kHz] and the number of shorts of the preliminary ejection K2 is set to a constant value of 45000 [shots]. A symbol ○ means that all the bubbles generated in the ink ejection opening arrays 86Ai and 86Bi are completely removed. Meanwhile, a symbol X means that the bubbles generated in the ink ejection opening arrays 86Ai and 86Bi are not completely removed.

TABLE 10

| Ejection Frequency 15 kHz | Number of Shots of Preliminary Ejection K1 | | | | | |
|---|---|---|---|---|---|---|
| Ejection Amount | 0 | 5000 | 7500 | 20000 | 95000 | 100000 |
| 5 pl | x | x | x | x | ○ | ○ |
| 2 pl | x | x | x | x | x | ○ |

As apparent from Table 10, it is confirmed that no recovery is achieved by 0 shot of the preliminary ejection K1 but the recovery effect is improved by increasing the number of shots.

Meanwhile, it is necessary to eject 45000 shots to achieve removal from the ink ejection opening array 86Bi whereas it is necessary to eject 100000 shots to achieve removal from the ink ejection opening array 86Ai. Hence it is confirmed that the number of shots necessary for the bubble removal is increased in the case of the ejection openings having the smaller diameter.

Consideration of Simultaneous Ink Ejection

Figure 18:
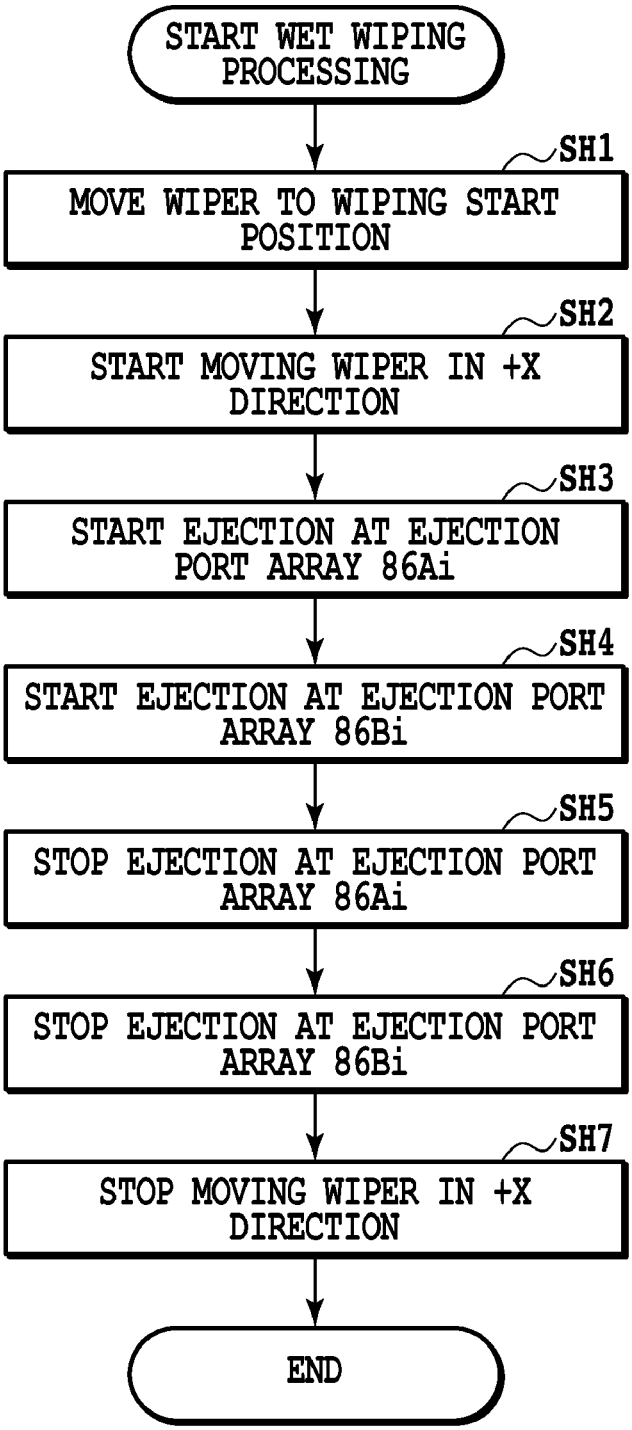
FIG. 18 is a flowchart showing an example of a program to be executed by a control unit in a wet wiping operation in the second embodiment of the recovery processing method for a print head according to the present invention when the control unit is formed of a microcomputer, for example.

In this embodiment, the wet wiping processing as shown in FIG. 18 is carried out so as to start ejection from the ink ejection opening array 86Ai and ejection from the ink ejection opening array 86Bi sequentially. However, the present invention is not limited only to this configuration and it is also possible to start ejection from the ink ejection opening array 86Ai and ejection from the ink ejection opening array 86Bi at the same timing as will be described later, for example.

An example of the wet wiping processing program to be executed by the above-described control unit 50, when the control unit 50 is formed of a microcomputer, for instance, will be described with reference to a flowchart shown in FIG. 19.

As shown in FIG. 17A, in step SJ1, the control unit 50 places the wiper 22 in the wiping start position $X=X_0$ at the amount of intrusion T (1.7 mm). Then the process goes to step SJ2. Next, in step SJ2, the control unit 50 forms the control data DR so as to move the wiper 22 at the moving velocity V (5 inch/s) in the +x coordinate axis direction which is orthogonal to the arrangement direction of the multiple ink ejection opening arrays 86Ai and 86Bi. The control unit 50 supplies the control data DR to the recovery system control circuit 68. In step SJ3 subsequent to step SJ2, the control unit 50 forms the preliminary ejection control data DP so as to start the preliminary ejection using the ink ejection opening arrays 86Ai and 86Bi at the same time in the predetermined position $X=X_1$ in front of the point where the wiper 22 passes through the ink ejection opening array 86A1. The control unit 50 supplies the preliminary ejection control data DP to the head drive control circuit 72 and the process goes to step SJ4. In subsequent step SJ4, the control unit 50 stops supplying the preliminary ejection control data DP immediately after the tip end of the wiper 22 passes through the ink ejection opening array 86Bi and thereby terminates the ink ejection. Then the process goes to step SJ5. In step SJ5, the control unit 50 stops the movement of the wiper 22 in the above-described +x coordinate axis direction and thereby terminates the wet wiping processing.

Figure 19:
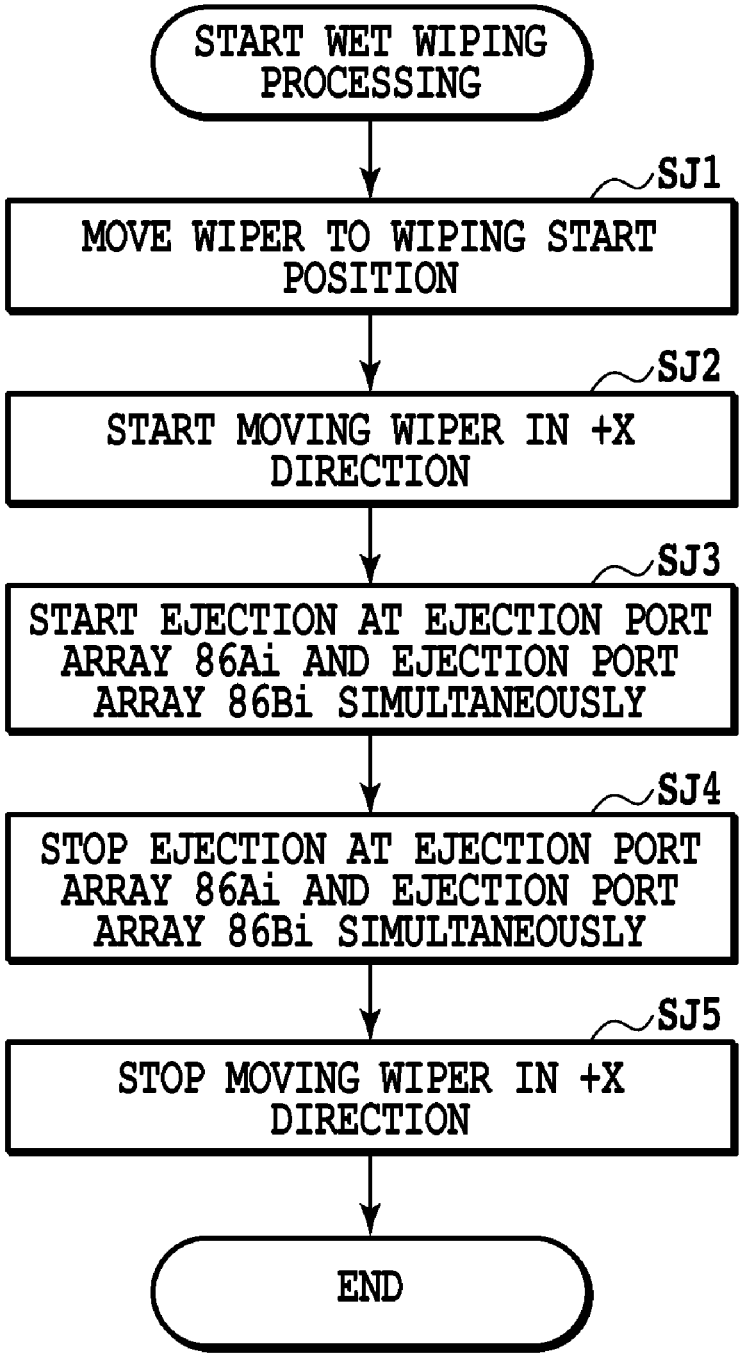
FIG. 19 is a flowchart showing another example of a program to be executed by a control unit in a wet wiping operation in the second embodiment of the recovery processing method for a print head according to the present invention when the control unit is formed of a microcomputer, for example.

As described above, it is confirmed that a similar performance of removing the paper fluff (dust) can be obtained by performing the wet wiping processing as shown in FIG. 19 while starting ejection from the ink ejection opening array 86Ai and ejection from the ink ejection opening array 86Bi simultaneously.

Therefore, the bubble removal processing is carried out after the wet wiping processing for removing the viscosity ink and the paper fluff (dust) adhering to the surface on the peripheral edge of the ink ejection opening is performed. As a consequence, there is confirmed that the recovery processing method is capable of enhancing the effect to remove the viscosity ink and the paper fluff (dust) adhering to the surface on the peripheral edge of the ink ejection opening without leaving bubbles inside the ink ejection opening even in the case of starting ejection from the ink ejection opening array 86Ai and ejection from the ink ejection opening array 86Bi simultaneously.

(Third Embodiment)

Figure 20:
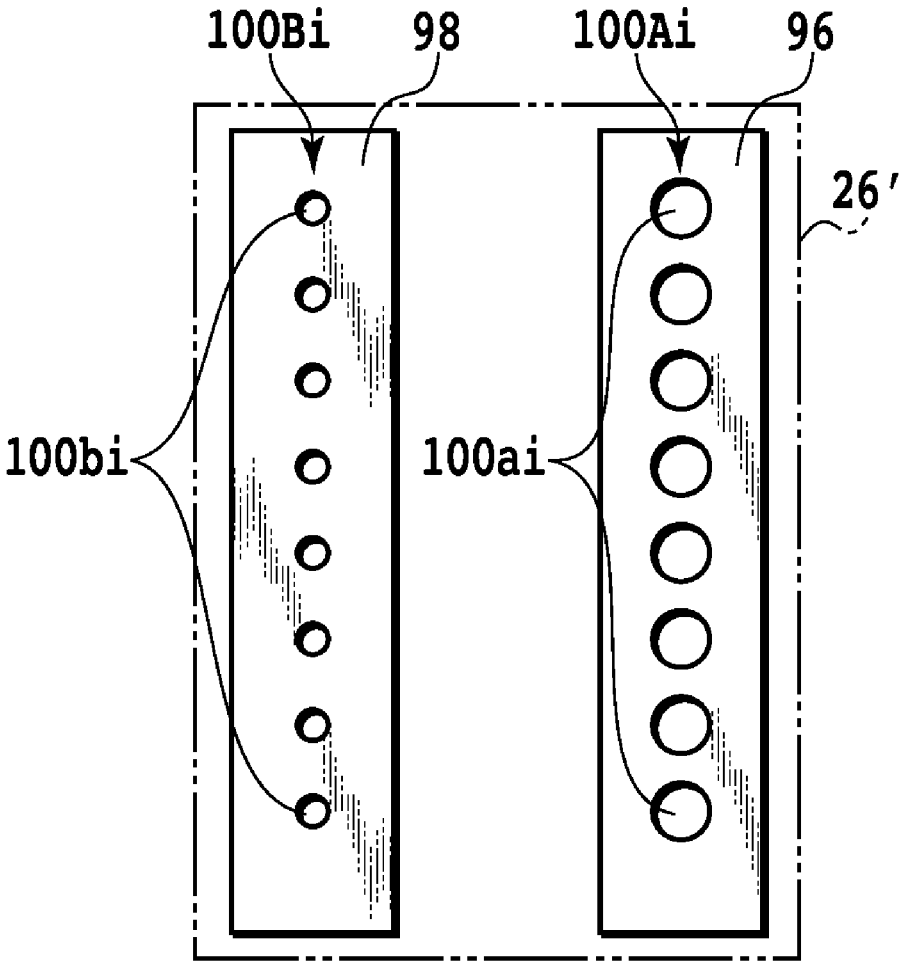
FIG. 20 is a partial enlarged plan view showing a part of a print head in a head ink cartridge to which a third embodiment of the recovery processing method for a print head according to the present invention is applied.

FIG. 20 shows principal part of a printing element board to which a third embodiment of the recovery processing method for a print head according to the present invention is applied.

Each printing element board to be described below includes a board made of silicon (Si) and provided with a thin film on a surface thereof, and an orifice plate to be formed on the board, for example.

An ink ejection opening array 100Ai including ink ejection openings 100*ai* provided on an orifice plate of a printing element board 96 is formed so as to correspond to an array of electrothermal conversion elements (not shown). Specifically, the single ink ejection opening array 100Ai is formed in a direction which is substantially orthogonal to the moving direction of the printing element board 96, i.e., the direction along the x coordinate axis in FIG. 2. Meanwhile, a single ink ejection opening array 100Bi including ink ejection openings 100*bi* provided on a printing element board 98 is formed in the direction substantially orthogonal to the moving direction of the printing element board 96, i.e., the direction along the x coordinate axis in FIG. 2, so as to correspond to the array of electrothermal conversion elements (not shown). Therefore, the print head is formed of the printing element board 96 and the printing element board 98.

Each ink ejection opening 100*ai* is made of a circular hole having a cross-sectional area capable of ejecting an ink droplet equal to 10 pl, for example. Each ink ejection opening 100*bi* is made of a circular hole having a cross-sectional area capable of ejecting an ink droplet equal to 5 pl, for example.

Figure 21A:
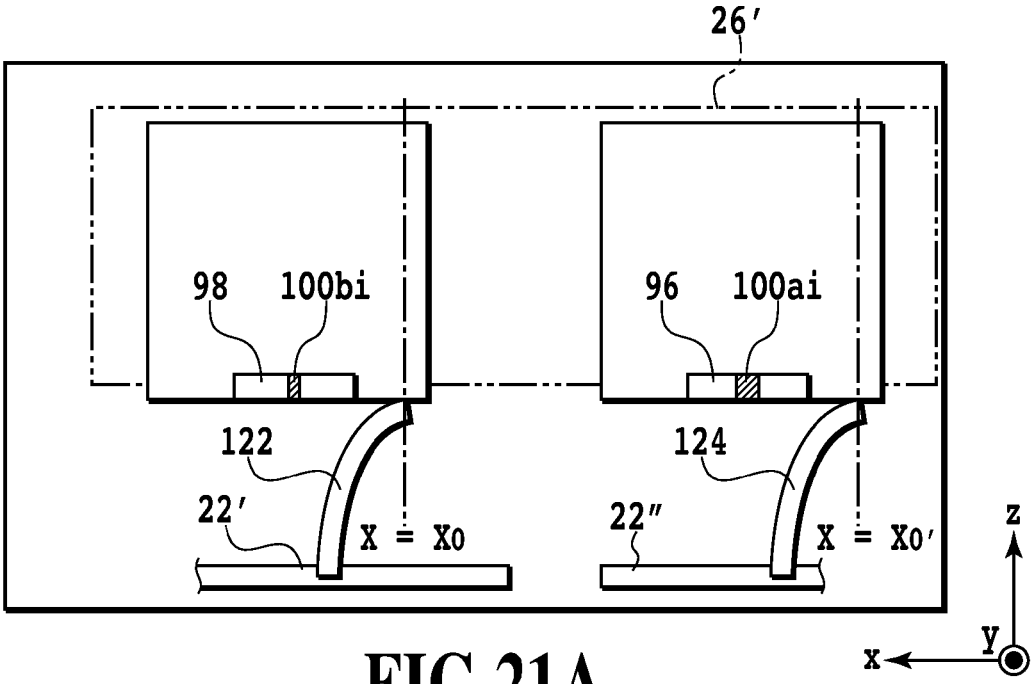
FIGS. 21A and 21B are views respectively made available for explaining operations in the third embodiment of the recovery processing method for a print head according to the present invention.

Moreover, as shown in FIG. 21A, the printing element board 96 and the printing element board 98 are supported by a head cartridge 26' with a predetermined interval therebetween. Meanwhile, a first wiper member 122 supported on a support plate 22' that is fixed to the home position H and a wiper 124 serving as a second wiper member supported on a support plate 22" are disposed substantially parallel to each other with a predetermined interval therebetween. The support plate 22' and the support plate 22" are supported by an unillustrated movement mechanism. Relative positions and heights between the support plate 22' and the support plate 22" can be freely set up. By using this configuration, it is possible to set up the amount of intrusion and the moving velocity used when the wiper 122 wipes the ink ejection opening array 100Bi to be different from the amount of intrusion and the moving velocity used when the wiper 124 wipes the ink ejection opening array 100Ai. Needless to say, even if the relative heights of both of the support plate 22' and the support plate 22" are the same, it is still possible to change the amounts of intrusion therebetween by adjusting installation heights of the two wipers.

Meanwhile, even if the support plate 22' and the support plate 22" are configured to allow only the free settings of the heights relative to each other, it is still possible to change the moving velocities of the two wipers by performing the wiping operations sequentially as long as the height of the wiper 124 is set so as not to contact the ink ejection opening array 100Bi while the wiper 122 is wiping the ink ejection opening array 100Ai, for example. The material of the wiper 122 is polyether urethane, for example. The dimensions thereof can be expressed as (direction of ejection opening array×height×thickness) or (25.15×13×1 mm), for example. The material of the wiper 124 is polyether urethane, for example. The dimensions thereof can be expressed as (direction of ejection opening array×height×thickness) or (29.5×13×1 mm), for example. The interval between the wiper 122 and the wiper 124 is set to 40 mm, for example.

The ink ejection opening forming surfaces of the printing element board 96 and the printing element board 98 are cleaned by tip ends of the wipers 124 and 122, respectively. Here, each of the ink ejection opening forming surfaces is caused to move at a predetermined amount of intrusion T (1.9 mm) and at a predetermined moving velocity such as 5 (inch/sec) relative to the tip end of the wiper 124 or 122.

In this configuration, the ink ejection opening forming surfaces of the printing element board 96 and the printing element board 98 are subjected to the wet wiping processing as shown in FIG. 9 and to the bubble removal processing as shown in FIG. 10.

Figure 21B:
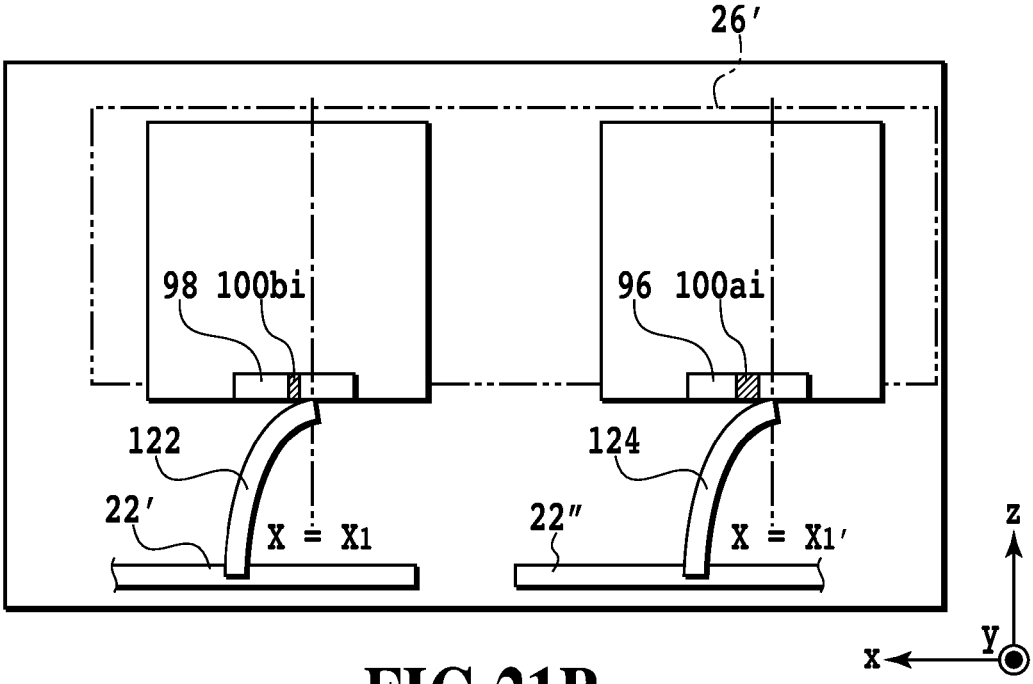

In the wet wiping processing, the ink ejection opening forming surface of the printing element board 98 is firstly placed in the wiper 122 in the wiping start position $X=X_0$. At this time, the ink ejection opening forming surface of the printing element board 96 is placed in the wiper 124 in the wiping start position $X=X_{0'}$ and at the amount of intrusion T. Next, the printing element boards 98 and 96 are caused to move in the direction of the x coordinate axis which is orthogonal to the arrangement direction of the multiple ink ejection opening arrays 100Ai and 100Bi and at the moving velocity V. Subsequently, as shown in FIG. 21B, the ink ejection opening array 100Ai and the ink ejection opening array 100Bi start ink ejection independently of each other when the tip end of the wiper 122 is located in a position $X=X_1$ before passing through the ink ejection opening array 100Bi and the tip end of the wiper 124 is located in a position $X=X_{1'}$ before passing through the ink ejection opening array 100Ai. The ink ejection opening array 100Bi terminates ink ejection in a position where the wiper 122 passed through the ink ejection opening array 100Bi while the ink ejection opening array 100Ai terminates ink ejection in a position where the wiper 124 passed through the ink ejection opening array 100Ai. Subsequently, the movement of the printing element board 96 and the printing element board 98 is stopped and the wet wiping processing is thereby terminated.

The performance of removing the viscosity ink and the paper fluff (dust) adhering to the ink ejection opening surfaces by carrying out the above-described wet wiping processing was verified.

In this embodiment as well, two viscosity ink substances FS adhere to peripheral edges of the ink ejection opening 100*ai* and the ink ejection opening 100*bi* as similar to the first embodiment. No bubbles and the like are generated in any of the ink ejection openings.

Upon verification of the removal performance, the printing element board 98 and the printing element board 96 in this state are subjected to the wet wiping processing according to this embodiment. After the wet wiping processing, the performance for removing the viscosity ink on the ink ejection opening forming surfaces is confirmed by using this print head.

As a result, it is confirmed that all the viscosity ink substances FS adhering to the print head were successfully removed.

However, there is also a case where the cap 14 is detached for a relatively long time because there are many print sheets and eight pieces of the viscosity ink FS adhere to the printing element boards 96 and 98 in the print head. In this case, it was not possible to remove all the viscosity ink FS successfully by one cleaning operation in accordance with the above-described wet wiping processing.

Table 11 shows results of recovery effects when the amounts of intrusion T of the wiper 122 and the wiper 124 are changed relative to the print head, the wiper 122 and the wiper 124 serving as the first wiper and the second wiper. It is to be noted that the moving velocity of the wiper 122 of the wiper 124 relative to the print head is set to a constant value of 5 (inch/sec) and the number of times of cleaning operations in accordance with the wet wiping process is set to a constant value of one operation. On Table 11, a symbol ○ means that all the viscosity ink existing inside the ink ejection opening arrays 100Ai and 100Bi is removed completely. Meanwhile, a symbol X means that all the viscosity ink existing inside the ink ejection opening arrays 100Ai and 100Bi is not removed completely.

TABLE 11

| Ejection | Amount of Intrusion T of Wiper (mm) | | |
|---|---|---|---|
| Amount | 1.5 | 1.7 | 1.9 |
| 10pl | x | ○ | ○ |
| 5pl | x | x | ○ |

As apparent from Table 11, it is confirmed that the viscosity ink is not removed completely by setting the amount of intrusion T of the wipers to the print head equal to 1.5 mm but it is possible to improve the removal effect by increasing the amount of intrusion T. This is attributed to a fact that a contact area of the tip end of each of the wipers becomes wider by increasing the amount of intrusion T. Hence more ink is allowed to adhere to the ink ejection opening forming surface so as to promote a function to dissolve the viscosity ink.

Moreover, in the case of the ink ejection opening array 100Ai, it is possible to remove the viscosity ink by setting the amount of intrusion T equal to or above 1.7 mm. On the other hand, in the case of the ink ejection opening array 100Bi, it is necessary to set the amount of intrusion T equal to or above 1.9 mm in order to remove the viscosity ink. Hence it is confirmed that the amount of intrusion of the wiper necessary for removal tends to be increased in the case of the ejection openings having smaller diameters.

Table 12 shows results of recovery effects when the moving velocity of the print head relative to the wipers is changed. It is to be noted that the amount of intrusion T of the wipers 122 and 124 is set to a constant value of 1.7 mm and the number of times of cleaning operations in accordance with the wet wiping process is set to a constant value of one operation. On Table 12, a symbol ○ means that all the viscosity ink existing inside the ink ejection opening arrays 100Ai and 100Bi is removed completely. Meanwhile, a symbol X means that all the viscosity ink existing inside the ink ejection opening arrays 100Ai and 100Bi is not removed completely.

TABLE 12

| Ejection | Velocity of Wiper (inch/s) | | |
|---|---|---|---|
| Amount | 3 | 5 | 7 |
| 10pl | ○ | ○ | x |
| 5pl | ○ | x | x |

As apparent from Table 12, it is not possible to remove the viscosity ink if the moving velocity of the print head relative to the wipers 122 and 124 is equal to 7 inch/sec. However, it is confirmed that the removal effect can be improved by decreasing the moving velocity. This is attributed to a fact that a contacting period of the tip end of each of the wipers becomes longer by decreasing the moving velocity. Hence more ink is allowed to adhere to the ink ejection opening forming surface so as to promote the function to dissolve the viscosity ink.

Moreover, in the case of the ink ejection opening array 100Ai, it is effective to set the moving velocity equal to or below 5 inch/sec in order to remove the viscosity ink. On the other hand, in the case of the ink ejection opening array 100Bi, it is necessary to set the moving velocity equal to 3 inch/sec in order to remove the viscosity ink. Hence it is confirmed that the moving velocity of the wipers effective for removing the viscosity ink substance tends to become slower in the case of the ejection openings having smaller diameters.

Table 13 shows results of recovery effects when the number of times of cleaning operations in accordance with the wet wiping processing is changed. It is to be noted that the amount of intrusion T of the wipers 122 and 124 relative to the print head is set to a constant value of 1.7 mm and the moving velocity of the wipers 122 and 124 relative to the print head is set to a constant value of 5 inch/sec. On Table 13, a symbol ○ means that all the viscosity ink existing inside the ink ejection opening arrays 100Ai and 100Bi is removed completely. Meanwhile, a symbol Xmeans that all the viscosity ink existing inside the ink ejection opening arrays 100Ai and 100Bi is not removed completely.

TABLE 13

| Ejection | Number of Times of Wet Wiping Operation | | | | |
|---|---|---|---|---|---|
| Amount | 0 | 1 | 2 | 4 | 6 |
| 10pl | x | ○ | ○ | ○ | ○ |
| 5pl | x | x | ○ | ○ | ○ |

As apparent from Table 13, it is not possible to achieve recovery without performing any cleaning operations in accordance with the wet wiping processing. However, it is confirmed that the effect to remove the viscosity ink is improved by increasing the number of times of the cleaning operations. This is attributed to a fact that the function to dissolve the viscosity ink is promoted by increasing the number of times.

Meanwhile, concerning the ejection opening array 100Ai, it is effective to carry out the cleaning operations once or more in accordance with the wet wiping processing in order to remove the viscosity ink. Concerning the ejection opening array 100Bi, it is effective to carry out the cleaning operations twice or more in accordance with the wet wiping processing in order to remove the viscosity ink. Hence it is confirmed that the number of times of cleaning operations in accordance with the wet wiping processing necessary for removing the viscosity ink substance tends to be increased in the case of the ejection openings having smaller diameters.

Moreover, in this embodiment, it is also possible to move the wipers 122 and 124 relative to the ink ejection opening forming surfaces of the print head instead. This example can also achieve a similar effect of removing the viscosity ink.

Further, in this embodiment, the type of the ink used in the print head is not questioned. However, if the different types of inks are used in the respective printing element boards, it is appropriate to increase the amount of intrusion for wiping, to decrease the moving velocity, and to increase the number of times of the cleaning operations applicable to the print head containing the ink that is more apt to cause adhesion. In this way, even when the type of the ink that is more apt to cause adhesion is used, it is still possible to achieve the effect of removing the viscosity ink similar to the case of using the type of the ink that is less apt to cause adhesion.

Now, the inventor has confirmed the printing performance of this print head. A printing pattern which allows checking of ink ejection and ejection failure of the respective ink ejection openings was used. As a result, it was confirmed that multiple ink ejection openings out of the respective print heads failed ejection and bubbles were generated inside the ink ejection openings that failed ejection.

As similar to the first embodiment, the recovery performance attributable to the bubble removal processing was also confirmed in this embodiment as shown in FIG. 10. As similar to the first embodiment, the print head with the bubbles AI generated inside the ink ejection openings 100*ai* and the ink ejection openings 100*bi* was used for verification.

Then, the printing performance of the print head was confirmed after the print head was subjected to the bubble removal processing. A printing pattern which allows checking of ink ejection, ejection failure, deflections, and the like of each of the respective ink ejection opening was used. As a result, it was confirmed that all the bubbles inside the print head were successfully removed.

As described above, in this embodiment as well, the bubble removal processing is carried out on the print head after the wet wiping processing for removing the viscosity ink and the paper fluff (dust) adhering to the surface on the peripheral edge of the ink ejection opening is performed. Therefore, it is possible to enhance the effect to remove the viscosity ink and the paper fluff (dust) adhering to the ink ejection opening forming surface without leaving bubbles inside the print head.

(Fourth Embodiment)

Figure 22:
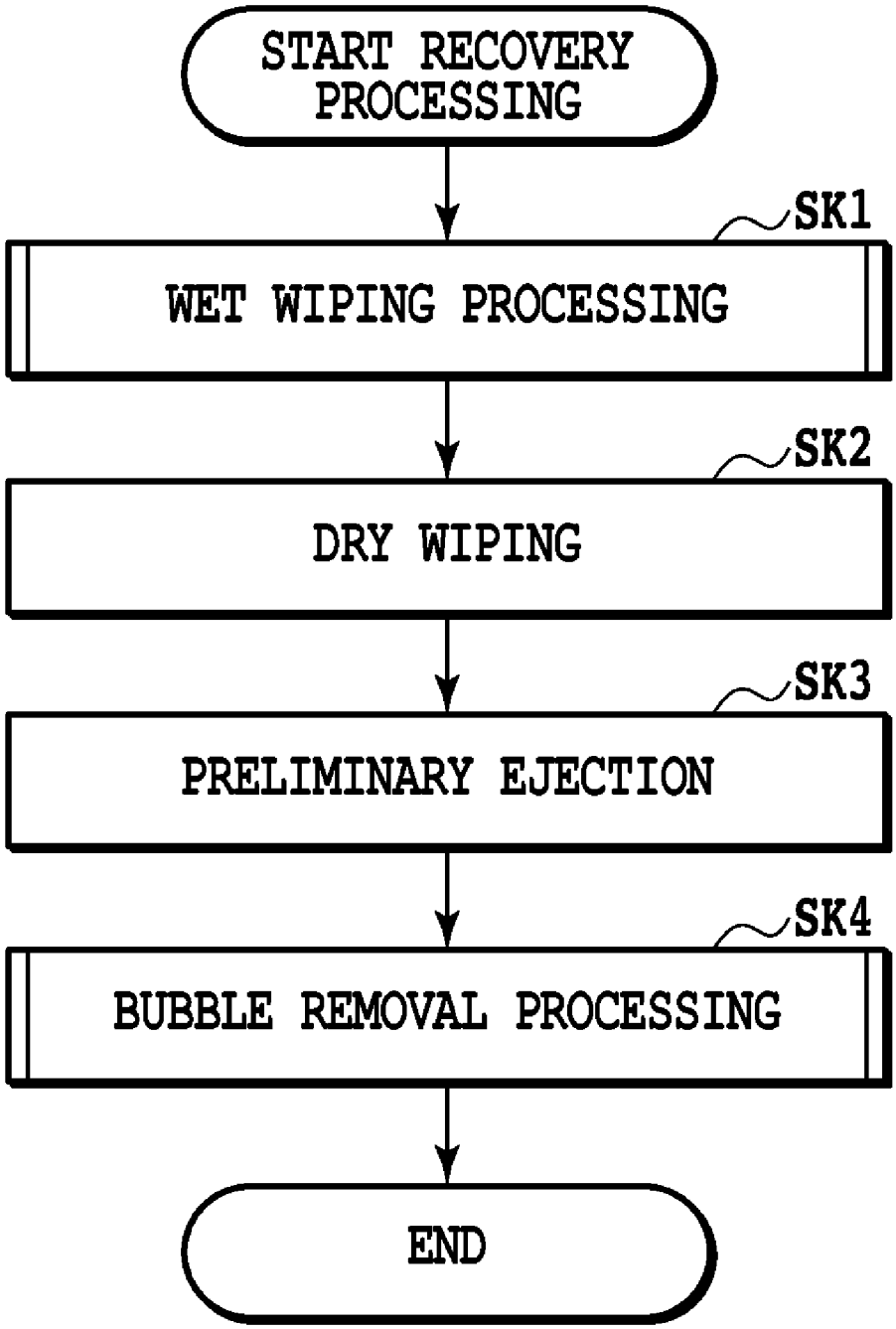
FIG. 22 is a flowchart showing an example of a program to be executed by a control unit in recovery processing in a fourth embodiment of the recovery processing method for a print head according to the present invention when the control unit is formed of a microcomputer, for example.

FIG. 22 is a flowchart showing an example of a recovery processing program to be executed by the control unit 50 in a fourth embodiment of the recovery processing method for a print head according to the present invention when the control unit 50 is formed of a microcomputer, for example. FIG. 22 is the flowchart showing the recovery processing to be executed upon confirmation of ejection failure attributable to adhesion of the viscosity ink substance FS.

The wiping processing in the first, second, and third embodiments consists of the wet wiping processing (a wet wiping operation). In this embodiment, normal wiping not associated with ejection (a dry wiping operation) is supposed to be executed after the wet wiping processing (the wet wiping operation) as shown in FIG. 22.

The print head to be used for description of this embodiment is based on the print head 44 provided with the ink ejection opening array capable of ejecting ink droplets each having a volume of 5 μl as shown in FIG. 3.

As shown in FIG. 22, after starting the recovery processing program, the control unit 50 executes a wet wiping processing program in step SK1 and then executes a dry wiping processing program in step SK2. In subsequent step SK3, a preliminary ejection program is executed for the purpose of discharging the ink pushed into the ink ejection openings in the course of dry wiping not associated with ink ejection. Then the process goes to step SK4. The bubble removal processing program is executed and then the program in step SK4. Then the program is terminated.

The inventor has executed verification of the performance of removing the viscosity ink and the paper fluff (dust) adhering to the ink ejection opening forming surface achieved by the above-described wet wiping processing.

Upon verification of the removal performance, it is assumed that the viscosity ink FS adheres to the inside of the ink ejection openings of the print head 44 to be subjected to the wet wiping processing. The viscosity ink FS adheres to the inside of the two ink ejection openings out of the eight ejection openings constituting the ink ejection opening array. No bubbles are generated inside the ink ejection openings.

The print head 44 in this state is subjected to the wet wiping processing as shown in FIG. 9. The amount of intrusion T of the wiper 22 relative to the print head 44 is set to a constant value of 1.7 mm and the moving velocity of the wiper 22 relative to the print head 44 is set to a constant value of 5 inch/sec.

After the wet wiping processing, the performance for removing the viscosity ink on the ink ejection opening forming surfaces is confirmed by using this print head 44. As a result, it is confirmed that all the viscosity ink FS is successfully removed.

However, there is also a case where the cap 14 is detached for relatively a long time because there are many print sheets and the viscosity ink FS adheres to the inside of all of the eight ink ejection openings of the ink ejection opening array. In this case, it is not possible to remove all the viscosity ink FS by carrying out only one cleaning operation consisting of the wet wiping processing.

Table 14 shows results of recovery effects when the number of times of the cleaning operations in accordance with the wet wiping processing is changed and then a cleaning operation in accordance with the dry wiping processing is performed when the viscosity ink FS adheres to the inside of the eight ink ejection openings of the ink ejection opening array. On Table 14, a symbol ○ means that all the viscosity ink existing inside the ink ejection opening array is removed completely. Meanwhile, a symbol X means that all the viscosity ink existing inside the ink ejection opening array is not removed completely.

TABLE 14

| | Number of Times of Wet Wiping Operations | | | | |
|---|---|---|---|---|---|
| | 0 | 1 | 2 | 4 | 6 |
| Removal Effect | x | ○ | ○ | ○ | ○ |

As apparent from Table 14, it is naturally impossible to achieve recovery without carrying out any cleaning operations in accordance with the wet wiping processing. However, the effect to remove the viscosity ink is observed by carrying out the wet wiping processing at least once and then carrying out the dry wiping processing once.

Moreover, it is also confirmed that the effect to remove the viscosity ink is further improved by increasing the number of times of the wet wiping processing to multiple times such as twice or more and then carrying out the dry wiping processing once.

In the first embodiment, it is necessary to carry out the cleaning operation at least twice in accordance with the wet wiping processing. On the other hand, it is confirmed that the number of times of the cleaning operations in accordance with the wet wiping processing can be reduced by carrying out the dry wiping processing after the wet wiping processing as described in this embodiment.

Note that this embodiment describes the example in which wiping conditions when the wet wiping is performed are the same as wiping conditions when the dry wiping is performed. However, it is also possible to change the wiping conditions between the wet wiping processing and the dry wiping processing depending on the structure of the print head, the types of the inks used, and so forth.

Table 15 shows results of effects to the amount of intrusion of the wiper by carrying out only the wet wiping processing and results of effects to the amount of intrusion of the wiper by carrying out only the dry wiping processing.

TABLE 15

| | Amount of Intrusion T of Wiper (mm) | | |
|---|---|---|---|
| | 1.5 | 1.7 | 1.9 |
| Wet | x | ○ | ○ |
| Dry | ○ | ○ | x |

As apparent from Table 15, it is found that a higher effect is brought about in wet wiping by setting a higher amount of intrusion of the wiper whereas a higher effect is brought about in dry wiping by setting a lower amount of intrusion of the wiper. This is attributed to a fact that the wet wiping processing is designed to spread the ink, which is a liquid, over the ink ejection opening forming surface by utilizing the large contact area of the wiper and thereby to dissolve the viscosity ink.

On the other hand, the dry wiping processing is designed to scrub the dissolved viscosity ink off by using an edge portion of the wiper. Accordingly, it is desirable to establish a relationship between the amount of intrusion T of the wiper for wet wiping and the amount of intrusion T of the wiper for dry wiping, which is defined as the amount of intrusion T of the wiper for wet wiping>the amount of intrusion T of the wiper for dry wiping.

Table 16 shows results of effects of wiper velocities when only the wet wiping processing is carried out and effects of wiper velocities when only the dry wiping processing is carried out.

TABLE 16

| | Wiper Velocity (inch/s) | | |
|---|---|---|---|
| | 1.5 | 1.7 | 1.9 |
| Wet | ○ | ○ | x |
| Dry | x | ○ | ○ |

As apparent from Table 16, it is found that a higher effect is brought about in wet wiping by setting a lower wiping velocity whereas a higher effect is brought about in dry wiping by setting a higher wiper velocity. This is attributed to a fact that the wet wiping processing is designed to spread the ink, which is a liquid, slowly over the ink ejection opening forming surface with the wiper and thereby to dissolve the viscosity ink. On the other hand, the dry wiping processing is designed to scrub the dissolved viscosity ink off quickly before the dissolved ink gets thickened again.

Accordingly, it is desirable to establish a relationship between the wiper velocity for wet wiping and the wiper velocity for dry wiping, which is defined as the wiper velocity for wet wiping<the wiper velocity for dry wiping.

In this embodiment, the wiper 22 is moved in the x coordinate axis direction which is orthogonal to the arrangement direction of the ink ejection opening array. However, the present invention is not limited only to this configuration and it is possible to achieve a similar effect of removing the viscosity ink by moving the wiper 22 in the y coordinate axis direction which is parallel to the arrangement direction of the ink ejection opening array. Further, although the wiper 22 is moved in this embodiment, the present invention is not limited only to this configuration. It is also possible to achieve a similar effect of removing the viscosity ink by moving the print head 44 instead. In addition, the inventor has confirmed the printing performance by using the verified print head. Here, the printing pattern which allows confirmation of ejection and ejection failure of each of the ink ejection openings was used. As a result, it was confirmed that multiple ink ejection openings failed ejection and bubbles were generated inside the ejection openings that failed ejection.

Then, the recovery performance of the bubble removal processing shown in FIG. 10 was also confirmed in this embodiment as similar to the first embodiment.

Upon confirmation of the recovery performance, the bubble removal processing as shown in FIG. 10 was carried out because there were multiple bubbles AI in the ink ejection opening array of the print head to be subjected to the bubble removal processing.

Moreover, the printing performance was confirmed by use of this print head. The printing pattern which allows checking of ink ejection or ejection failure from each of the ink ejection openings, as well as deflections and other defects was used. As a result, it was confirmed that all the bubbles were successfully removed.

As described above, in this embodiment, the dry wiping processing and the preliminary ejection processing are carried out after the wet wiping processing for removing the viscosity ink and the paper fluff (dust) adhering to the surfaces on the ink ejection openings was performed. Thereafter, the bubble removal processing is also carried out. In this way, it is possible to enhance the effect to remove the viscosity ink and the paper fluff (dust) adhering to the ink ejection opening forming surface without leaving bubbles inside the ink ejection openings.

(Other Embodiments)

The above-described embodiments have been based on the configuration not provided with a suction pump, which is often used in conventional ink jet printing apparatuses.

Accordingly, this embodiment will describe a configuration including such a suction pump. A print head to be used in this embodiment is assumed to be the print head 44 as shown in FIG. 3.

In this embodiment as well, viscosity ink substances respectively adhere to two ink ejection openings as similar to the first embodiment.

The recovery processing to be executed upon confirmation of ejection failure attributable to adhesion of the viscosity ink substances FS is the same as the recovery processing shown in FIG. 1. In this embodiment, the wet wiping processing to be executed is the same as the wet wiping processing as shown in FIG. 9, which has been described in conjunction with the first embodiment. As similar to the results in the first embodiment, it is confirmed that all the viscosity ink substances are successfully removed.

Nevertheless, there are bubbles AI generated inside the ink ejection openings as similar to the first embodiment.

A bubble removal processing program in this embodiment is executed by use of a suction pump configured to suction and remove the bubbles.

The suction unit a treatment to suction and remove the bubbles while occluding the ink ejection opening forming surface of the print head 44. Specifically, the suction corresponds to the recovery processing by way of a suctioning operation of generating a negative pressure inside the cap by use of the suction pump and suctioning the bubble generated inside the ink ejection opening together with the ink. Here, the suction pump is connected to an end of a connection tube and the other end of the connection tube is inserted to the cap.

Moreover, a blank suctioning operation for discharging the ink pooled inside the cap is executed after releasing of the cap and then the ink adhering to the ink ejection openings surface of the print head after the suctioning operation is removed by wiping with the wiper, thereby enabling normal ejection. Concerning a suctioning condition in this case, it is only necessary to perform a moderate suctioning operation using a predetermined negative pressure which is adequate for removing the bubbles generated by wet wiping.

In this embodiment as well, the recovery performance after the suction has been confirmed by the inventor. Here, the bubbles AI are respectively located inside multiple ink ejection openings of the print head 44 to be subjected to the bubble removal processing.

The recovery operation was executed by use of the suction pump. Then, the printing performance was confirmed by use of this print head 44. The printing pattern which allows checking of ink ejection or ejection failure from each of the ink ejection openings, as well as deflections and other defects is used. As a result, it was confirmed that all the bubbles were successfully removed.

As described above, in this embodiment, the wet wiping processing is executed in order to remove the viscosity ink and the paper fluff (dust) adhering to the ink ejection opening forming surface, and then the bubble removal processing is carried out by use of suction recovering unit configured to discharge the ink out of the ink ejection opening using the suction pump. In this way, it is possible to enhance the effect to remove the viscosity ink and the paper fluff (dust) adhering to the surface of the ink ejection opening without leaving a bubble inside the ink ejection opening.

While the preset invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-278754, filed Dec. 8, 2009,which is hereby incorporated by reference herein in its entirety.

What is claimed is:

1. An inkjet priming apparatus comprising:

a print head having an ejection opening surface where at least one ejection opening array composed of a plurality of ink ejection openings configured to eject an ink droplet is formed;

a wiper member configured to wipe the ejection opening surface;

an adjustment unit for adjusting the temperature of the print head; and a recovery controlling unit for controlling a recovery of the ink droplet ejecting operation in the plurality of ink ejection openings such that (i) a wiping operation for wiping the ejection opening surface by the wiper member, (ii) a first preliminary ejecting operation for ejecting the ink droplet from the print head with the temperature of the print head being adjusted at a first temperature by the adjustment unit, and (iii) a second preliminary ejecting operation for ejecting the ink droplet from the print head with the temperature of the print head being adjusted at a second temperature lower than the first temperature by the adjustment unit are performed in this order, wherein the recovery controlling unit controls the recovery so as to eject the ink droplets from the plurality of ink ejection openings during the wiping operation.

2. The inkjet printing apparatus according to claim 1, wherein the control unit causes the print head to start ejection of the ink from the ink ejection openings toward the wiper member before the wiper member reaches the ink ejection openings, and to stop ejection of the ink after the wiper member passes over the ink ejection openings.

3. The inkjet printing apparatus according to claim 1, wherein the print head has at least two ink ejection opening arrays formed parallel to each other, and the control unit causes the movement mechanism to execute the operation to remove the adhered substance by slidably touching the wiper member to the ink ejection opening forming surface of the print head, while causing the print head to eject the ink toward the wiper member from the two ink ejection opening arrays at different timings.

4. The inkjet printing apparatus according to claim 1, wherein the print head has at least two ink ejection opening arrays formed parallel to each other, and the control unit causes the movement mechanism to execute the operation to remove the adhered substance by slidably touching the wiper member to the ink ejection opening forming surface of the print head while causing the print head to eject the ink toward the wiper member from the two ink ejection opening arrays at the same time.

5. The inkjet printing apparatus according to claim 1, wherein the recovery controlling unit controls the recovery such that the wiper member wipes the ejection opening surface several times at the time of the wiping operation.

6. The inkjet printing apparatus according to claim 1, wherein the wiper member moves along the arrangement direction of the plurality of the ink ejection openings.

7. The inkjet printing apparatus according to claim 1, wherein the wiper member moves along the direction which is orthogonal to the arrangement direction of the plurality of the ink ejection openings.

8. The inkjet printing apparatus according to claim 1, further comprising a plurality of electrothermal conversion elements for generating thermal energy to eject the ink droplets which correspond with each of the ink ejection openings.

9. The inkjet printing apparatus according to claim 8, wherein the adjustment unit adjusts the temperature of the print head by driving the plurality of electrothermal conversion elements to heat the print head.

10. The inkjet printing apparatus according to claim 1, further comprising a heating unit for heating the print head, wherein the adjustment unit adjusts the temperature of the print head by driving the heating unit to heat the print head.

11. The inkjet priming apparatus according to claim 1, wherein the ejection opening array of the print head is formed by a first ejection opening array and a second ejection opening array, and one ink droplet ejected from the ejection openings of the first ejection opening array contains more ink than one ink droplet ejected from the ejection openings of the second ejection opening array.

12. The inkjet printing apparatus according to claim 1, wherein the recovery controlling unit controls the recovery such that the wiper member wipes the ejection opening surface without ejecting the ink droplets from the plurality of the ink ejection openings after the wiping operation, and before the first preliminary ejecting operation.

* * * * *